US006869241B2

(12) United States Patent
Ouchi et al.

(10) Patent No.: US 6,869,241 B2
(45) Date of Patent: Mar. 22, 2005

(54) PRINTER AND PRINTING METHOD FOR OBTAINING A REMAINING PRINTABLE DISTANCE ON THE REAR END SIDE OF A PAPER

(75) Inventors: Tetsuya Ouchi, Aichi (JP); Yoshinari Morimoto, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/626,700

(22) Filed: Jul. 25, 2003

(65) Prior Publication Data

US 2004/0156666 A1 Aug. 12, 2004

(30) Foreign Application Priority Data

Jul. 26, 2002 (JP) ..... 2002-217490

(51) Int. Cl.[7] ..... B41J 13/00; B41J 13/26; B41F 1/34; B65H 7/02

(52) U.S. Cl. ..... 400/578; 400/630; 400/582; 400/709; 101/485; 271/265.01; 271/265.02

(58) Field of Search ..... 400/578, 708, 400/582, 630, 709; 101/485; 347/104; 358/296, 449; 399/17, 58, 260, 370, 376, 389, 371; 250/559.3; 271/265.02, 265.01

(56) References Cited

U.S. PATENT DOCUMENTS 4,290,593 A * 9/1981 Irvine ..... 271/42
4,929,844 A * 5/1990 Houjiyou et al. ..... 250/559.2
4,934,686 A * 6/1990 Ono et al. ..... 271/117
5,148,221 A * 9/1992 Gokita ..... 399/58
5,291,225 A * 3/1994 Saito ..... 346/134
5,476,545 A * 12/1995 Schrauwers et al. ..... 118/668
5,495,326 A * 2/1996 Mikida ..... 399/43
5,500,725 A * 3/1996 Takasu et al. ..... 399/17
5,547,181 A * 8/1996 Underwood ..... 271/114
5,568,573 A * 10/1996 Wada et al. ..... 382/317
5,875,033 A 2/1999 Kawata et al. ..... 358/296
5,875,380 A * 2/1999 Iwata et al. ..... 399/301
6,029,572 A * 2/2000 Rodi ..... 101/215
6,070,048 A * 5/2000 Nonaka et al. ..... 399/376
6,268,937 B1 * 7/2001 Kim ..... 358/488
6,315,473 B1 * 11/2001 Slippy ..... 400/578
6,647,240 B2 * 11/2003 Fujii ..... 399/371
6,718,879 B2 * 4/2004 Dreher et al. ..... 101/485
2002/0054381 A1 * 5/2002 Iwase ..... 358/498

FOREIGN PATENT DOCUMENTS

JP A 8-99770 4/1996
JP B2 2694691 9/1997

* cited by examiner

*Primary Examiner*—Andrew H. Hirshfeld
*Assistant Examiner*—Wasseem H. Hamdan
(74) *Attorney, Agent, or Firm*—Oliff & Berridge, PLC

(57) ABSTRACT

A printer includes: a paper transport unit; a print unit including a print head; a downstream sensor mounted on the print head; an upstream sensor disposed upstream of the downstream sensor; and a control unit. The control unit makes the paper transport unit transport paper at a first speed of low speed and a second speed of high speed. The control unit obtains first and second transport distances with which the paper has been transported since being detected by the upstream sensor and till being detected by the downstream sensor, while transporting the paper at the first and second speeds. The control unit calculates a response delay time of the upstream sensor from a difference between the first transport distance and the second transport distance, and corrects a remaining printable distance on a paper rear end side on the basis of the response delay time.

14 Claims, 16 Drawing Sheets

(CONT.)

(FIG. 17 CONTINUED)
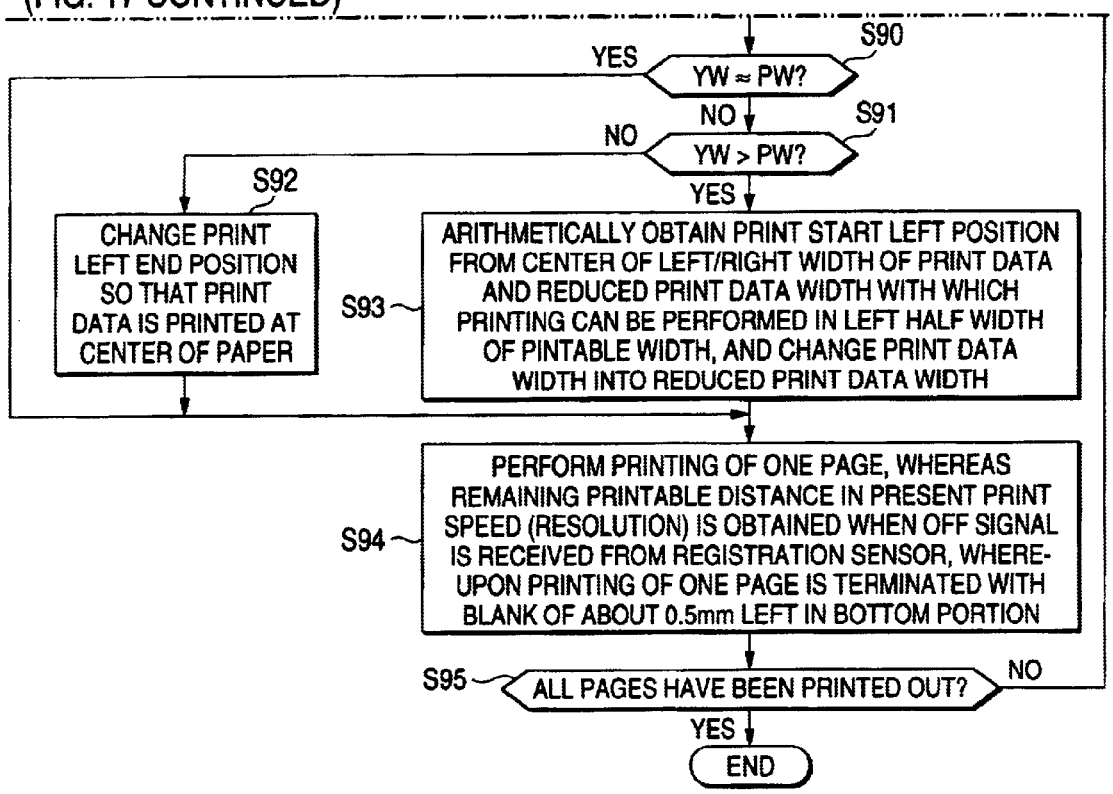

PRINTER AND PRINTING METHOD FOR OBTAINING A REMAINING PRINTABLE DISTANCE ON THE REAR END SIDE OF A PAPER

BACKGROUND OF THE INVENTION

1. Field of the Invention

The present invention relates to a printer having a print unit and a printing method. Particularly, the present invention relates to a printer and a printing method improved to obtain a remaining printable distance on the rear end side of paper accurately.

2. Background Art

In the related art, a printer having an inkjet print unit is provided with a paper transport mechanism for transporting paper fed thereto from a paper feed mechanism. A carriage movable in the scanning direction and a print head mounted on the carriage are provided somewhere in a paper transport path. A registration roller is provided upstream of the carriage in a transport-direction of the paper, and a registration sensor is provided upstream of the registration roller. The front end or rear end of the paper is detected on the basis of a detection signal of the registration sensor. A remaining printable distance or the like required for printing up to the vicinity of the rear end of the paper is calculated also using the transport distance of the paper transported by the transport mechanism.

The registration sensor has a rotary arm protruding to the paper transport path so as to be rotated by the paper, a photointerrupter for detecting the rotation of the rotary arm, a spring member for urging the rotary arm, and so on. It takes a predetermined operating time $t_o$ for the registration sensor to turn off (changeover from presence of paper to absence of paper) after the rear end of the paper passes through the registration sensor. Thus, there occurs a detection error in paper end detection (error in transport distance) due to the operating time $t_o$. That is, the transport distance during the operating time $t_o$ when the paper is transported at a low speed is short, while the transport distance during the operating time $t_o$ when the paper is transported at a high speed becomes longer than that at the time of the low-speed transportation. That is, the detection error in detecting the paper end increases with the increase of the transport speed.

Therefore, an image forming apparatus according to Japanese Patent No. 3,026,917 includes a paper size detection unit for detecting the length of paper based on a detection signal from a registration sensor. The paper is transported to pass through the registration sensor at different transport speeds. A correction value corresponding to the detection error is obtained experimentally based on transport distances corresponding to the different transport speeds. The correction value obtained experimentally is applied to any image forming apparatus of the same machine type so that the paper length detected by the paper size detection unit is corrected by the correction value.

As described above, in the image forming apparatus disclosed in the aforementioned official gazette, the correction value corresponding to the detection error is obtained experimentally. The correction value obtained experimentally is applied to any image forming apparatus of the same machine type so that the paper length detected by the paper size detection unit is corrected by the correction value.

However, a registration sensor in any image forming apparatus of the same machine type has a manufacturing error proper to its constituent parts (rotary arm, spring member, etc.) individually. Thus, there is a difference in performance among registration sensors. The operating time is not also fixed.

According to the technique according to Japanese Patent No. 3,026,917, the correction value obtained experimentally is applied to any image forming apparatus of the same machine type. As a result, the detection error cannot be corrected in consideration of the difference in operating time among registration sensors. Thus, there is a limit in correcting the detection error of the paper length.

On the other hand, recent inkjet printers are very often used for printing photographs taken by digital cameras. When a photograph is printed by an inkjet printer, it may be printed on the whole surface of paper. In this case, when the detection error in detection of the rear end of the paper by a registration sensor is large, there is a problem that there occurs a blank space on the lower end side of the paper or a picture image is short thereon.

SUMMARY OF THE INVENTION

The present invention has been made to solve the above problems, and therefore one object of the present invention is to provide a printer and a printing method, which enhance accuracy in detection of a rear end of paper.

It is another object of the invention is to provide a printer and a printing method, which enhance accuracy in detection of a remaining printable distance on the rear end side of the paper.

To achieve the above objects, the invention provides a printer including: a paper transport unit that transports paper fed thereto; a print unit that prints on the paper, including a print head; a downstream sensor mounted on the print head and capable of detecting the paper; an upstream sensor disposed upstream of the downstream sensor in a paper-transport-direction and capable of detecting the paper; a first measuring unit configured to make the paper transport unit transport the paper at a first speed of low speed while making the upstream sensor detect a rear end of the paper, and to make the paper transport unit transport the paper till the downstream sensor detects the rear end of the paper, so as to obtain a first transport distance with which the paper has been transported since being detected by the upstream sensor and till being detected by the downstream sensor; a second measuring unit configured to make the paper transport unit transport the paper at a second speed of high speed while making the upstream sensor detect the rear end of the paper, and to make the paper transport unit transport the paper till the downstream sensor detects the rear end of the paper, so as to obtain a second transport distance with which the paper has been transported since being detected by the upstream sensor and till being detected by the downstream sensor; a response delay calculating unit configured to calculate a response delay time of the upstream sensor from a difference between the first transport distance and the second transport distance; and a correction unit configured to correct a remaining printable distance on a paper rear end side after detecting the rear end of the paper by the upstream sensor, on the basis of the response delay time.

For example, in a tune-up stage of the printer after assembling, the first measuring unit makes the paper transport unit transport the paper at a first speed of low speed while making the upstream sensor detect a rear end of the paper, and then makes the paper transport unit transport the paper till the downstream sensor detects the rear end of the paper. Thus, the first measuring unit obtains a first transport distance with which the paper has been transported since being detected by the upstream sensor and till being detected by the downstream sensor. In this case, the movement distance (transport distance as an error) with which the paper moves during the sensor operating time (response delay time) required for a sensor signal to change over after the rear end of the paper passes through the upstream sensor is slight because the rear end of the paper is detected by the upstream sensor while being transported at the first speed which is low. Therefore, the first transport distance with which the paper has been transported since being detected by the upstream sensor and till being detected by the downstream sensor is a transport distance including only a slight error.

For example, in a tune-up stage of the printer after assembling, the second measuring unit makes the paper transport unit transport the paper at a second speed of high speed while making the upstream sensor detect a rear end of the paper, and then makes the paper transport unit transport the paper till the downstream sensor detects the rear end of the paper. Thus, the second measuring unit obtains a second transport distance with which the paper has been transported since being detected by the upstream sensor and till being detected by the downstream sensor. For example, the "high speed" means a speed several times as fast as the "low speed".

In this case, the movement distance (transport distance as an error) with which the paper moves during the sensor operating time (response delay time) required for a sensor signal to change over after the rear end of the paper passes through the upstream sensor is significant because the rear end of the paper is detected by the upstream sensor while being transported at the second speed which is high. Therefore, the second transport distance with which the paper has been transported since being detected by the upstream sensor and till being detected by the downstream sensor is a transport distance including a significant error.

For example, in a tune-up stage of the printer after assembling, the response delay calculating unit calculates a response delay time of the upstream sensor on the basis of a difference between the first transport distance and the second transport distance and stores the calculated response delay time into a control unit of the printer. Incidentally, the phrase "stores into a control unit" includes the case of storing into a memory in the form of digital data and the case of setting in a device other than a memory. The response delay time t of the upstream sensor can be obtained by the arithmetic expression $t=(D1-D2)/V$ where D1 designates the first transport distance, D2 designates the second transport distance, and V designates the high transport speed. The response delay time t is stored into the control unit of the printer.

For example, in a use stage of the printer after assembling, the correction unit corrects a remaining printable distance on the paper rear end side after detecting the rear end of the paper by the upstream sensor, by use of the response delay time stored in the control unit. In order to calculate the remaining printable distance on the paper rear end side after detecting the rear end of the paper by the upstream sensor in consideration of the movement distance with which the paper moves during the response delay time, the paper movement distance is obtained by use of the response delay time and the transport speed during printing, and the remaining printable distance on the paper rear end side is corrected with the obtained paper movement distance.

Thus, it is possible to enhance the accuracy of calculation of the remaining printable distance on the paper rear end side after detection of the rear end of the paper by the upstream sensor. As a result, when an image or the like is printed up to the lower end of paper, it is possible to solve the problem that there occurs a blank space, a picture image is short, etc.

The invention may provide a printing method in a printer, wherein the printer includes a downstream sensor capable of detecting paper, and an upstream sensor disposed upstream of the downstream sensor in a paper-transport-direction and capable of detecting the paper. The method includes: detecting a rear end of the paper by the upstream sensor and the downstream sensor while transporting the paper at a first speed of low speed; obtaining a first transport distance with which the paper has been transported since being detected by the upstream sensor and till being detected by the downstream sensor, while transporting the paper at the first speed; detecting the rear end of the paper by the upstream sensor and the downstream sensor while transporting the paper at a second speed of high speed; obtaining a second transport distance with which the paper has been transported since being detected by the upstream sensor and till being detected by the downstream sensor, while transporting the paper at the second speed; calculating a response delay time of the upstream sensor from a difference between the first transport distance and the second transport distance; and correcting a remaining printable distance on a paper rear end side after detecting the rear end of the paper by the upstream sensor, on the basis of the response delay time.

The invention may provide a printer including: a downstream sensor capable of detecting the paper; an upstream sensor disposed upstream in a paper-transport-direction of the downstream sensor and capable of detecting the paper; means for obtaining a first transport distance with which the paper has been transported since being detected by the upstream sensor and till being detected by the downstream sensor, while transporting the paper at a first speed of low speed; means for obtaining a second transport distance with which the paper has been transported since being detected by the upstream sensor and till being detected by the downstream sensor, while transporting the paper at a second speed of high speed; means for calculating a response delay time of the upstream sensor from a difference between the first transport distance and the second transport distance; and means for correcting a remaining printable distance on a paper rear end side after detecting the rear end of the paper by the upstream sensor, on the basis of the response delay time.

BRIEF DESCRIPTION OF THE DRAWINGS

The present invention may be more readily described with reference to the accompanying drawings, in which.

DETAILED DESCRIPTION OF THE PREFERRED EMBODIMENTS

An embodiment of the invention will be described below with reference to the drawings. This embodiment shows an example in which the invention has been applied to a multifunctional apparatus having a printer function, a copying machine function, a scanner function, a facsimile machine function, a telephone function, and so on.

Figure 1:
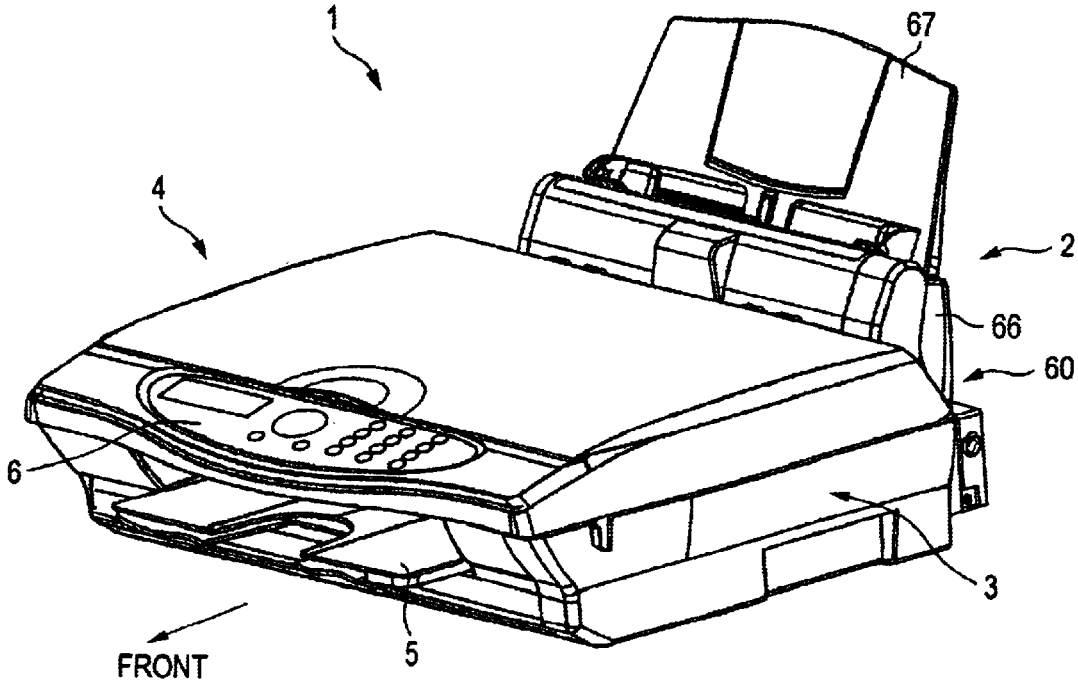
FIG. 1 is a perspective view of a multifunctional apparatus including a printer according to an embodiment of the invention.

As shown in FIG. 1, a multifunctional apparatus 1 has a paper feeder 2 in its rear end portion. An inkjet printer 3 is provided in front of the lower portion of the paper feeder 2. A reader 4 for the copying machine function and the facsimile machine function is provided above the printer 3. A paper delivery tray 5 is provided in front of the printer 3, and an operation panel 6 is provided in the front-end top surface portion of the reader 4.

Description will be made on the printer 3.

Figure 2:
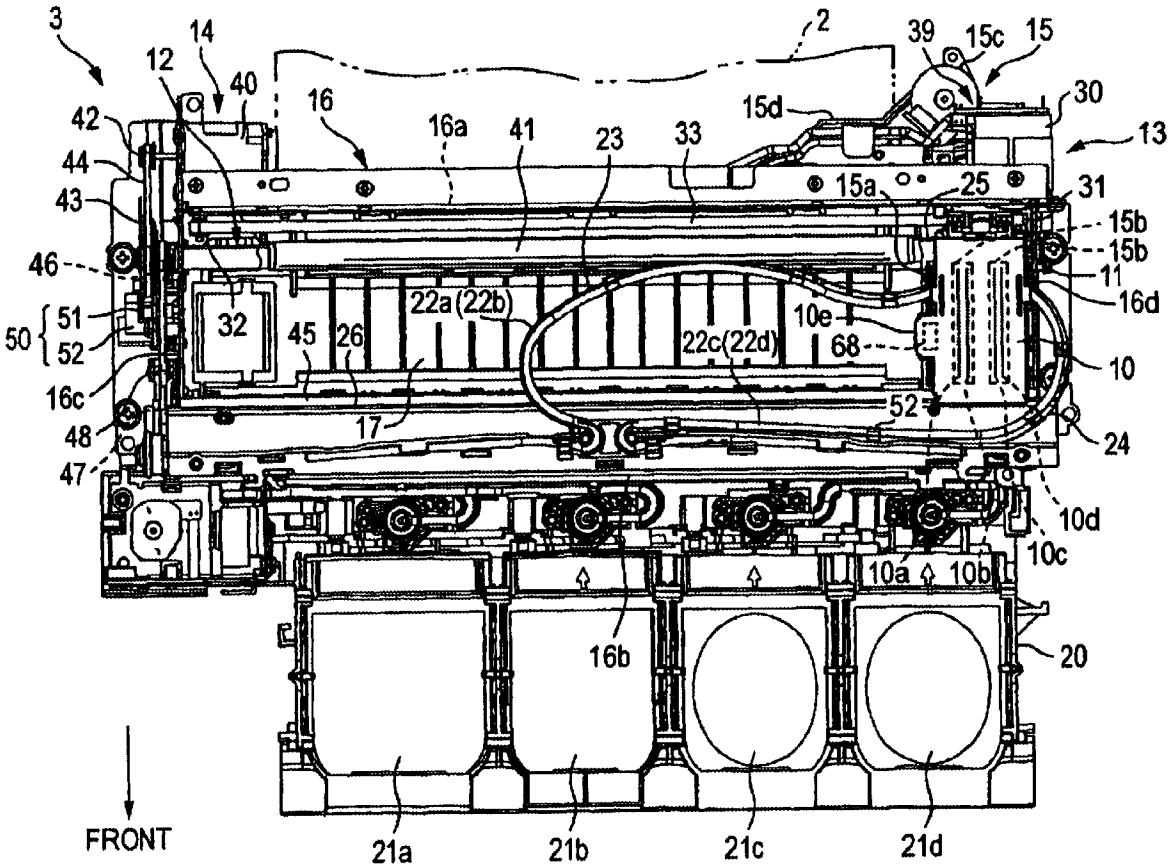
FIG. 2 is a cross-sectional view of the printer.

As shown in FIG. 2, the printer 3 has a print head 10, a carriage 11 mounted with the print head 10, a guide mechanism 12 for guiding and supporting the carriage 11 movably in the left/right direction which is a scanning direction, a carriage moving mechanism for moving the carriage 11 in the left/right direction, a paper transport mechanism 14 for transporting paper P fed thereto by the paper feeder 2, a maintenance mechanism 15 for the print head 10, and so on.

The printer 3 is provided with a frame 16 like a rectangular parallelepiped long in the left/right direction and short in the vertical width. The guide mechanism 12, the carriage moving mechanism 13, the paper transport mechanism 14, the maintenance mechanism 15, and so on, are attached to the frame 16. The print head 10 and the carriage 11 are received inside the frame 16 movably in the left/right direction.

A paper inlet and a paper outlet (not shown) are formed in a rear side panel 16*a* and a front side panel 16*b* of the frame 16 respectively. The paper P fed from the paper feeder 2 is introduced into the frame 16 through the paper inlet, transported forward by the paper transport mechanism 14, and discharged from the paper outlet to the paper delivery tray 5 in front of the paper outlet. A platen 17 having a plurality of ribs is attached to the bottom surface portion of the frame 16. Inside the frame 16, printing onto the paper P on the platen 17 is carried out by the print head 10.

Four ink nozzle sets 10*a* to 10*d* are provided in the print head 10 so as to look downward. Inks of four colors (black, cyan, yellow and magenta) can be sprayed downward from the ink nozzle sets 10*a* to 10*d* so as to print on the paper P. Four color ink cartridges 21*a* to 21*d* attached to a cartridge insertion portion 20 in front of the frame 16 are connected to the print head 10 through four flexible ink tubes 22*a* to 22*d* passing through the frame 16 respectively. Thus, the four color inks are supplied to the print head 10.

In addition, two left and right FPCs (Flexible Print Circuits) 23 and 24 are disposed inside the frame 16. The left FPC 23 extends to the print head 10 integrally with the two ink tubes 22*a* and 22*b*, and is connected to the print head 10. The right FPC 24 extends to the print head 10 integrally with the two ink tubes 22*c* and 22*d*, and is connected to the print head 10. Each of the FPCs 23 and 24 has a plurality of signal lines electrically connected to a control unit 70 (see FIG. 5) and the print head 10.

The guide mechanism 12 has a guide shaft 25 and a guide rail 26. The guide shaft 25 is disposed in a rear portion inside the frame 16 so as to extend in the left/right direction. The left and right opposite end portions of the guide shaft 25 are coupled with a left side panel 16*c* and a right side panel 16*d* of the frame 16. The guide rail 26 is formed in a front portion inside the frame 16 so as to extend in the left/right direction. The rear end portion of the carriage 11 is fitted to the outside of the guide shaft 25 slidably thereon, and the front end portion of the carriage 11 is engaged with the guide rail 26 slidably thereon.

The carriage moving mechanism 13 has a carriage motor 30, a driving pulley 31, a driven pulley 32, a belt 33 and so on. The carriage motor 30 is attached to the rear side of the right end portion of the rear side panel 16*a* of the frame 16 so as to look forward. The driving pulley 31 is driven to rotate by the carriage motor 30. The driven pulley 32 is supported rotatably in the left end portion of the rear side panel 16*a*. The belt 33 is laid between the pulleys 31 and 32 and fixed to the carriage 11. In order to detect the movement distance of the carriage 11 (print head 10), an encoder 39 is provided near the carriage motor 30.

The paper transport mechanism 14 has a paper transport motor 40, a registration roller 41, a driving pulley 42, a driven pulley 43 and a belt 44. The paper transport motor 40 is attached to a portion of the left side panel 16*c* of the frame 16 protruding to the rear side from the rear side panel 16*a*, so that the paper transport motor 40 looks to the left. The registration roller 41 is disposed under the guide shaft 25 inside the frame 16 so as to extend in the left/right direction. The left and right opposite end portions of the registration roller 41 are supported rotatably on the left side panel 16*c* and the right side panel 16*d*. The driving pulley 42 is driven to rotate by the paper transport motor 40. The driven pulley 43 is coupled with the left end portion of the registration roller 41. The belt 44 is laid between the pulleys 42 and 43. When the paper transport motor 40 is driven, the registration roller 41 rotates so that the paper P can be transported in the front/back direction. Although the registration roller 41 is shown emphatically in FIG. 2, in fact the registration roller 41 is disposed under the guide shaft 25.

The paper transport mechanism 14 further has a paper delivery roller 45, driven pulleys 46 and 47, and a belt 48. The paper delivery roller 45 is disposed in a front portion inside the frame 16 so as to extend in the left/right direction. The left and right opposite end portions of the paper delivery roller 45 are supported rotatably on the left side panel 16*c* and the right side panel 16*d*. The driven pulley 46 is provided integrally with the driven pulley 43. The driven pulley 47 is coupled with the left end portion of the paper delivery roller 45. The belt 48 is laid between the pulleys 46 and 47. When the paper transport motor 40 is driven, the paper delivery roller 45 rotates so that the paper P can be discharged toward the paper delivery tray 5 in front of the paper delivery roller 45.

An encoder disk 51 is fixed to the driven pulley 43. A photointerrupter 52 having a light-emitting portion and a light-receiving portion is attached to the left side panel 16*c* so as to hold the encoder disk 51 between the photointerrupter 52 and the left side panel 16*c*. The paper transport motor 40 is controlled by the control unit 70 to drive on the basis of a detection signal from this paper transport encoder 50 (photointerrupter 52).

Incidentally, the maintenance mechanism 15 has a wiper 15*a,* two caps 15*b* and a common drive motor 15*c*. The wiper 15*a* wipes the head surface of the print head 10. Each cap 15*b* can seal up two sets of the four ink nozzle sets 10*a* to 10*d*. The common drive motor 15*c* drives the wiper 15*a* and the caps 15*b* respectively. The wiper 15*a,* the caps 15*b,* the drive motor 15*c,* and so on, are attached to a mounting plate 15*d,* and the mounting plate 15*d* is fixed to the right portion of the bottom plate of the frame 16 from its lower surface side.

Figure 3:
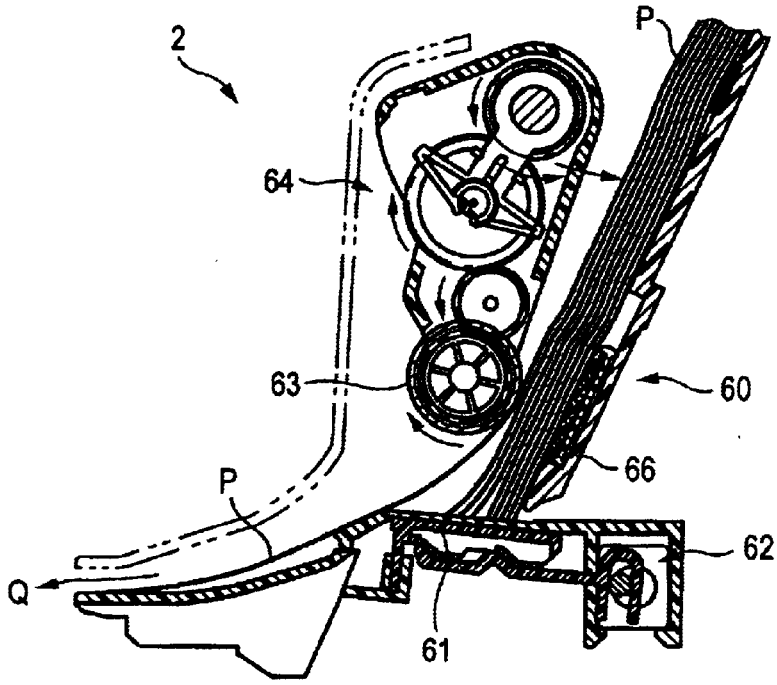
FIG. 3 is a longitudinal sectional view of a paper feeder.
Figure 5:
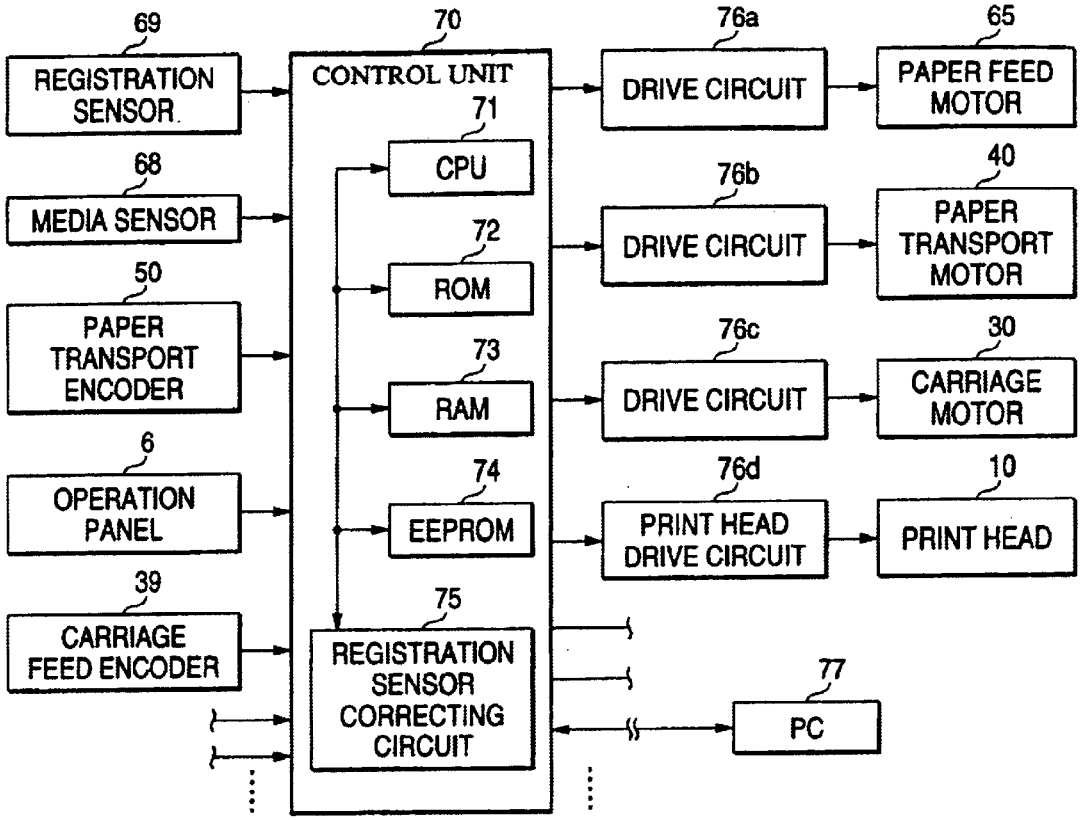
FIG. 5 is a block diagram of a control system.

As shown in FIG. 3, the paper feeder 2 has a paper holding portion 60, a pair of left and right stoppers 61, a stopper position changeover mechanism 62, a paper feed mechanism 64, and a common paper feed motor 65 (see FIG. 5). The paper holding portion 60 holds the paper P in an inclined posture. The stoppers 61 are provided on the bottom surface side of the paper holding portion 60. The stopper position changeover mechanism 62 changes over the position of the stoppers 61 between an upper position and a lower position. The paper feed mechanism 64 includes a paper feed roller 63 for feeding the paper P held by the paper holding portion 60. The paper feed motor 65 drives the stopper position changeover mechanism 62 and the paper feed mechanism 64. The paper holding portion 60 has an inclined wall portion 66 integral with a printer case. An extension paper guide plate 67 (see FIG. 1) is detachably attached to the inclined wall portion 66. Incidentally, for example, the paper feeder 2 has a configuration equivalent to that of a paper feeder shown in the specification and drawings included in U.S. patent application Ser. No. 10/390,825, the content of which are hereby incorporated by reference. Therefore, description of the paper feeder 2 will be omitted.

Figure 7:
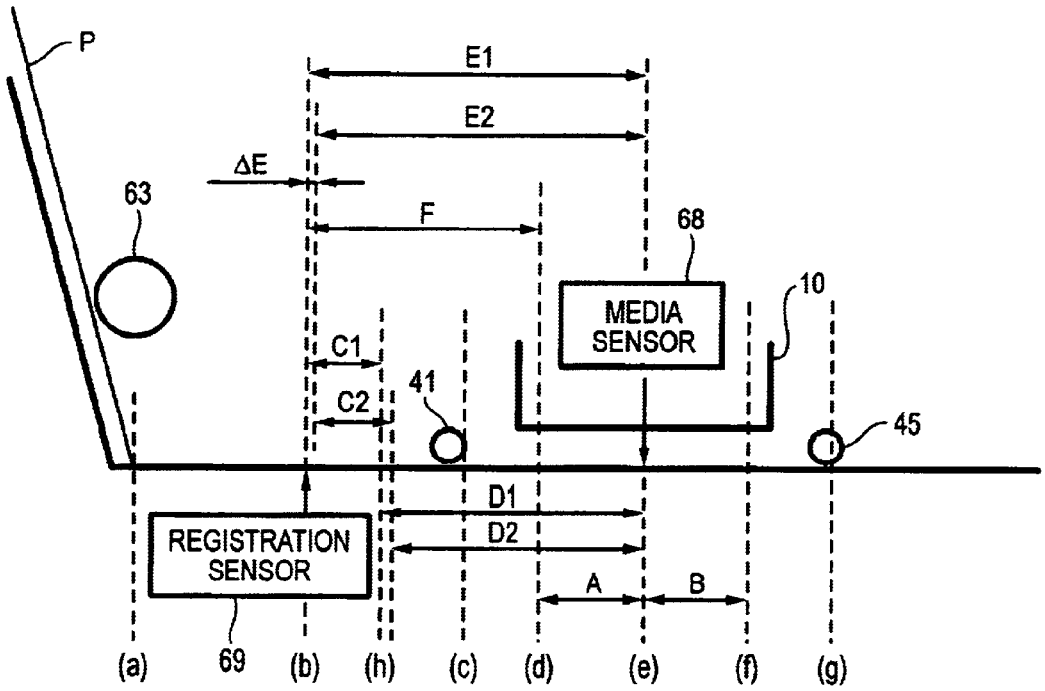
FIG. 7 is a schematic diagram showing the arrangement of a print head, sensors, rollers, etc.

As shown in FIGS. 2 and 7, a media sensor 68 as a downstream sensor capable of detecting the front end portion, the rear end portion, the width, and the like, of the paper P, is provided in the left end portion of the print head 10. The media sensor 68 is an optical sensor including a light-emitting portion and a light-receiving portion. The media sensor 68 is attached to a sensor mounting portion 10*e* of the print head 10 protruding to the left, so that the media sensor 68 looks downward.

Figure 4:
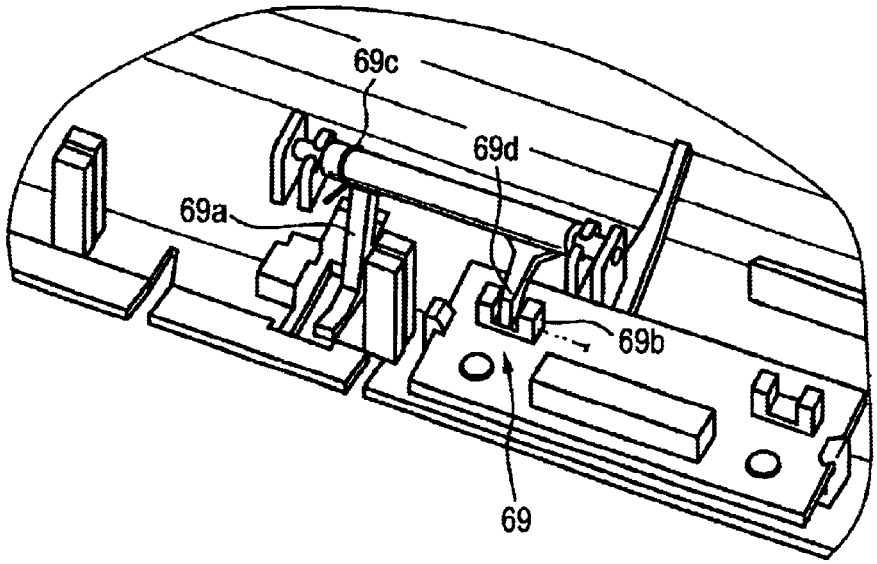
FIG. 4 is a view of a registration sensor.

In addition, as shown in FIGS. 4 and 7, a registration sensor 69 as an upstream sensor capable of detecting the existence of the paper P or the front end portion and the rear end portion of the paper P is provided upstream (that is, rear side) of the media sensor 68 in the paper-transport-direction. The registration sensor 69 is, for example, a mechanical sensor having a detector 69*a,* a photointerrupter 69*b* and a torsion spring 69*c*. The detector 69*a* is attached to the front end portion of a top cover forming a transport path of the paper feeder 2. The detector 69*a* protrudes into the paper transport path. The detector 69*a* coming in contact with the paper P is rotated by the paper P. The photointerrupter 69*b* detects the rotation of the detector 69*a*. The torsion spring 69*c* urges the detector 69*a* toward the paper transport path.

A shield portion 69*d* is provided integrally with the detector 69*a*. When the paper P is passing through the registration sensor 69, the shield portion 69*d* is out of position between the light-emitting portion and the light-receiving portion so as to turn the registration sensor on. When the paper P is not passing through the registration sensor 69, the shield portion 69*d* shields between the light-emitting portion and the light-receiving portion so as to turn the registration sensor off. Incidentally, it takes a predetermined operating time Δt for the registration sensor 69 to turn off after the rear end of the paper has passed through the registration sensor 69.

Any registration sensor 69 in any printer 3 of the same machine type has a manufacturing error proper to its constituent parts (rotary arm 69*a,* torsion spring 69*b,* etc.) individually. Thus, there is a difference in performance among individual registration sensors 69, and the operating time Δt is not fixed. Particularly according to the invention, the response delay time Δt which is the operating time of the registration sensor 69 is calculated for each machine type, and the remaining printable distance on the rear end side of the paper after detecting the rear end of the paper by the registration sensor 69 is corrected using the response delay time Δt.

Next, the control unit 70 will be described.

As shown in FIG. 5, the control unit 70 has a microcomputer having a CPU (central processing unit) 71, a ROM (read only memory) 72, an RAM (random access memory) 73 and an EEPROM (electronically erasable and programmable read only memory) 74, and a registration sensor correction circuit 75. The registration sensor 69, the media sensor 68, the paper transport encoder 50, the operation panel 6, the carriage feed encoder 39, and so on, are electrically connected to the control unit 70.

In addition, drive circuits 76*a* to 76*c* for driving the paper feed motor 65, the paper transport motor 40 and the carriage motor 30 respectively, and a print head drive circuit 76*d* for driving the print head 10 are electrically connected to the control unit 70, while a personal computer 77 (PC 77) can be connected thereto.

Figure 6:
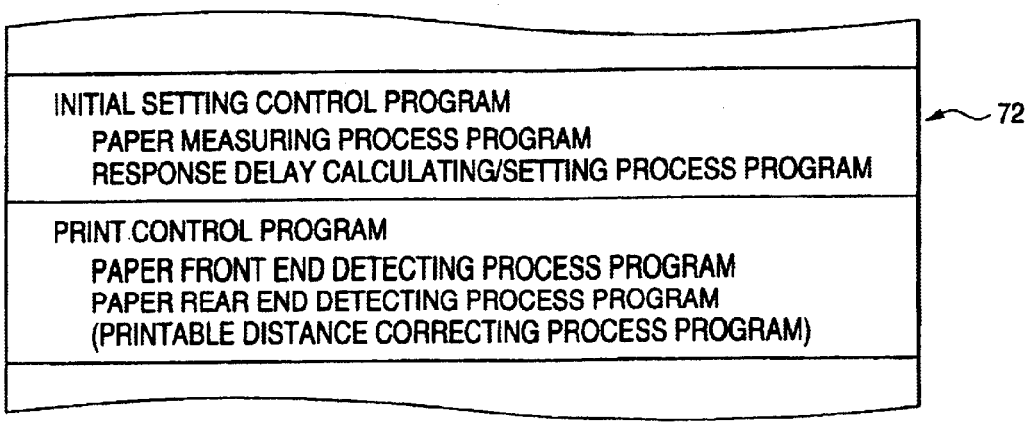
FIG. 6 is a diagram showing programs stored in a ROM.

As shown in FIG. 6, an initial setting control program for performing initial setting in a tune-up stage of the printer 3 after assembling, and a print control program for performing printing in a use stage of the printer 3 are stored in the ROM 72. The initial setting control program includes a paper measuring process program and a response delay calculating/setting process program. The print control program includes a paper front end detecting process program, and a paper rear end detecting process program having a printable distance correcting process program.

The print control program also includes a program for performing printing in a plurality of modes each corresponding to mutually different print resolutions executable by the printer 3. The plurality of modes include a speed priority mode for performing printing with the lowest resolution of 300 dpi, a normal mode for performing printing with a normal resolution of 600 dpi and a quality-of image priority mode for performing printing with the highest resolution of 1200 dpi. The print control program causes the control unit 70 to control the drive circuit 76*a* and 76*b* so that the paper transport speed is variable according to the mode to be executed. Specifically, the paper transport speed of each mode is set to be slower as the print resolution increases.

The paper measuring process program for initial setting is a program as follows. That is, in a tune-up stage of the printer 3 after assembling, the rear end of the paper P is detected by the registration sensor 69 while the paper P is transported at a first speed V1 of low speed (for example, 1 ips (inch per second)) by the paper transport mechanism 14. After that, the paper P is transported till the rear end of the paper is detected by the media sensor 68. Thus, a first transport distance E1 with which the paper P has been transported since being detected by the registration sensor 69 and till being detected by the media sensor 68 is obtained. In addition, the rear end of the paper P is detected by the registration sensor 69 while the paper P is transported at a second speed V2 of high speed (for example, 8 ips) by the paper transport mechanism 14. After that, the paper P is transported till the rear end of the paper is detected by the media sensor 68. Thus, a second transport distance E2 with which the paper P has been transported since being detected by the registration sensor 69 and till being detected by the media sensor 68 is obtained.

Incidentally, the first speed V1 corresponds to a paper transport speed in the quality-of-image priority mode, which is the minimum speed for transporting paper in the printing operation of the printer 3. The second speed V2 corresponds to a paper transport speed in the speed priority mode, which is the maximum speed for transporting paper in the printing operation of the printer 3.

The second speed V2 may correspond to a paper transport speed in a skip operation of the printer 3. The skip operation is performed when the print head 10 reaches blank region, such as top or bottom blanks or blank lines, included in an image to be formed on paper. In the skip operation, the control unit 70 controls the paper transport motor 40 to transport paper with high speed but does not drive the print head 10, whereby the blank region is skipped while no printing operation is executed. The response delay calculating/setting process program for initial setting is a program as follows. That is, in a tune-up stage of the printer 3 after assembling, the response delay time Δt of the registration sensor 69 is calculated using the first and second transport distances E1 and E2, and stored in the EEPROM 74. The response delay time Δt is set for the registration sensor correction circuit 75 (corresponding to the upstream sensor correcting unit).

The printable distance correcting process program for print control is a program as follows. That is, in a use stage of the printer 3, the remaining printable distance on the rear end side of the paper after detecting the rear end of the paper by the registration sensor 69 is corrected using the response delay time Δt stored in the EEPROM 74 (set for the registration sensor correction circuit 75).

FIG. 7 is a schematic diagram showing the arrangement of the print head 10, the media sensor 68, the registration sensor 69, the paper feed roller 63, the registration roller 41, the paper delivery roller 45, and so on. Here, assume that positions (a) to (h) are set. Particularly, the registration sensor position (b) is a position where the registration sensor 69 starts its operation (rotating operation of the detector 69*a*) when the rear end of the paper P transported downstream passes through the registration sensor 69. The No.0 nozzle position (d) is a nozzle position corresponding to a print start position, which nozzle position is a position of a nozzle set located most upstream of the nozzle sets 10*a* to 10*d* of the print head 10.

Next, control to be executed by the control unit 70 based on the paper measuring process program in a tune-up stage of the printer 3 will be described with reference to the flow charts of FIGS. 9 to 12, and control to be executed by the control unit 70 based on the response delay calculating/setting process program will be described with reference to the flow chart of FIG. 13. Incidentally, each reference sign Si (i=1, 2, 3 . . . ) in each flow chart designates each step. In the paper measuring process, a first paper measuring process and a second paper measuring process are included. The first paper measuring process performs measurement with the paper transport speed set as the first speed V1 (1 ips) when the rear end of the paper passes through the registration sensor 69. The second paper measuring process performs measurement with the paper transport speed set as the second speed V2 (8 ips) likewise.

For example, the first and second paper measuring processes are started in response to their corresponding paper measuring process start operations performed through the operation panel 6 by a tuning operator respectively. However, the second paper measuring process may be started automatically following the termination of the first paper measuring process once the first paper measuring process is started. Further, the response delay calculating/setting process may be started automatically following the termination of the second paper measuring process.

Figure 9:
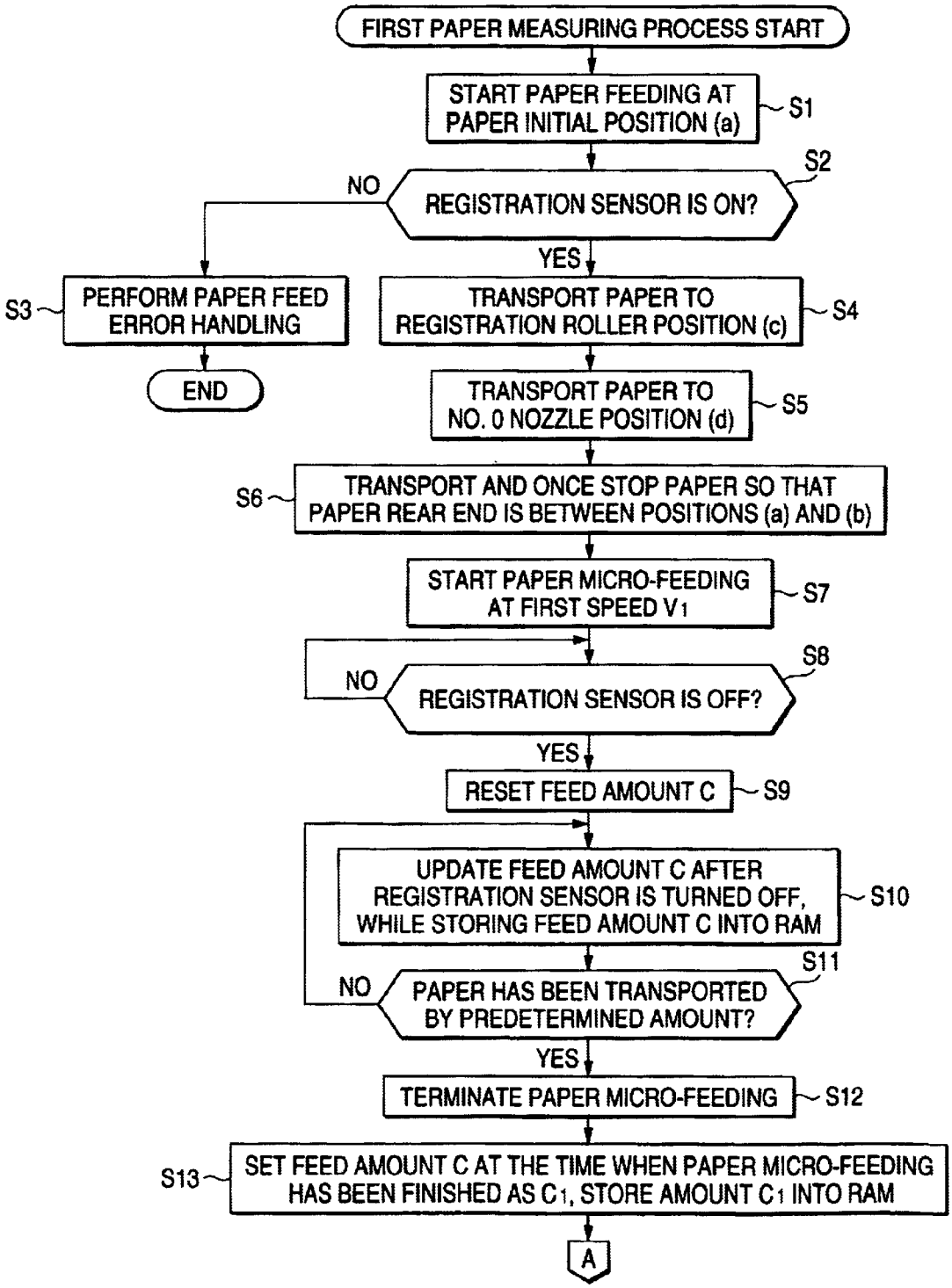
FIG. 9 is a flow chart of the first half of a first paper measurement process.

As shown in FIG. 9, as soon as the first paper measuring process is started, the paper feed roller 63 of the paper feed mechanism 64 rotates in the paper feed direction so that paper feeding is started at the paper initial position (a) (S1). At that time, the registration sensor 69 is off. After that, for example, when the registration sensor 69 is not turned on even after a predetermined time has passed (S2; No), this is regarded as a paper feed error, and error handling (S3) is executed. Thus, the process is terminated.

When the registration sensor 69 is turned on (S2; Yes) after paper feeding is started in S1, next the paper P is transported to the registration roller position (c) (S4). After that, the paper P is transported to the No.0 nozzle position (d) by the registration roller 41 of the paper transport mechanism 14 (S5). Next, the paper P is transported and once stopped so that the rear end of the paper is located between the paper initial position (a) and the registration sensor position (b) (S6). After that, micro-feeding of the paper is started with the paper transport speed set as the first speed V1 (1 ips) (S7).

The micro-feeding of the paper is kept on for a distance enough for the paper to go through the registration sensor position (b), that is, the micro-feeding of the paper is kept on till the rear end of the paper P reaches the paper transport temporary stop position (h) in FIG. 7. Incidentally, as for the paper transport temporary stop position (h), the distance to the No.0 nozzle position (d) or the media sensor position (e) does not have to be defined. The paper transport temporary stop position (h) serves as a standard for temporarily stopping the paper P short of the media sensor 68 in order to improve the accuracy of detection of the rear end of the paper by the media sensor 68, as will be described later. In the state where the micro-feeding of the paper is started, the registration sensor 69 is on. Next, it is judged whether the registration sensor 69 is off or not (S8). When the rear end of the micro-fed paper P passes through the registration sensor 69 so that the registration sensor 69 is actuated and turned off (S8; Yes), a feed amount C is reset (S9). After that, once the registration sensor 69 is turned off, the feed amount C is counted based on a detection signal from the paper transport encoder 50, and stored in the RAM 73 so as to be updated (S10).

After that, when the paper P is transported by a predetermined feed amount required for the rear end of the paper to reach the paper transport temporary stop position (h) (S11; Yes), the micro-feeding of the paper is terminated (S12). The feed amount C at the time of the termination of the micro-feeding of the paper is stored as C1 in the RAM 73 (S13). Here, as shown in FIG. 7, the position (h) of the rear end of the micro-fed paper P is substantially a position advanced downstream by the feed amount C1 from the registration sensor position (b).

Figure 10:
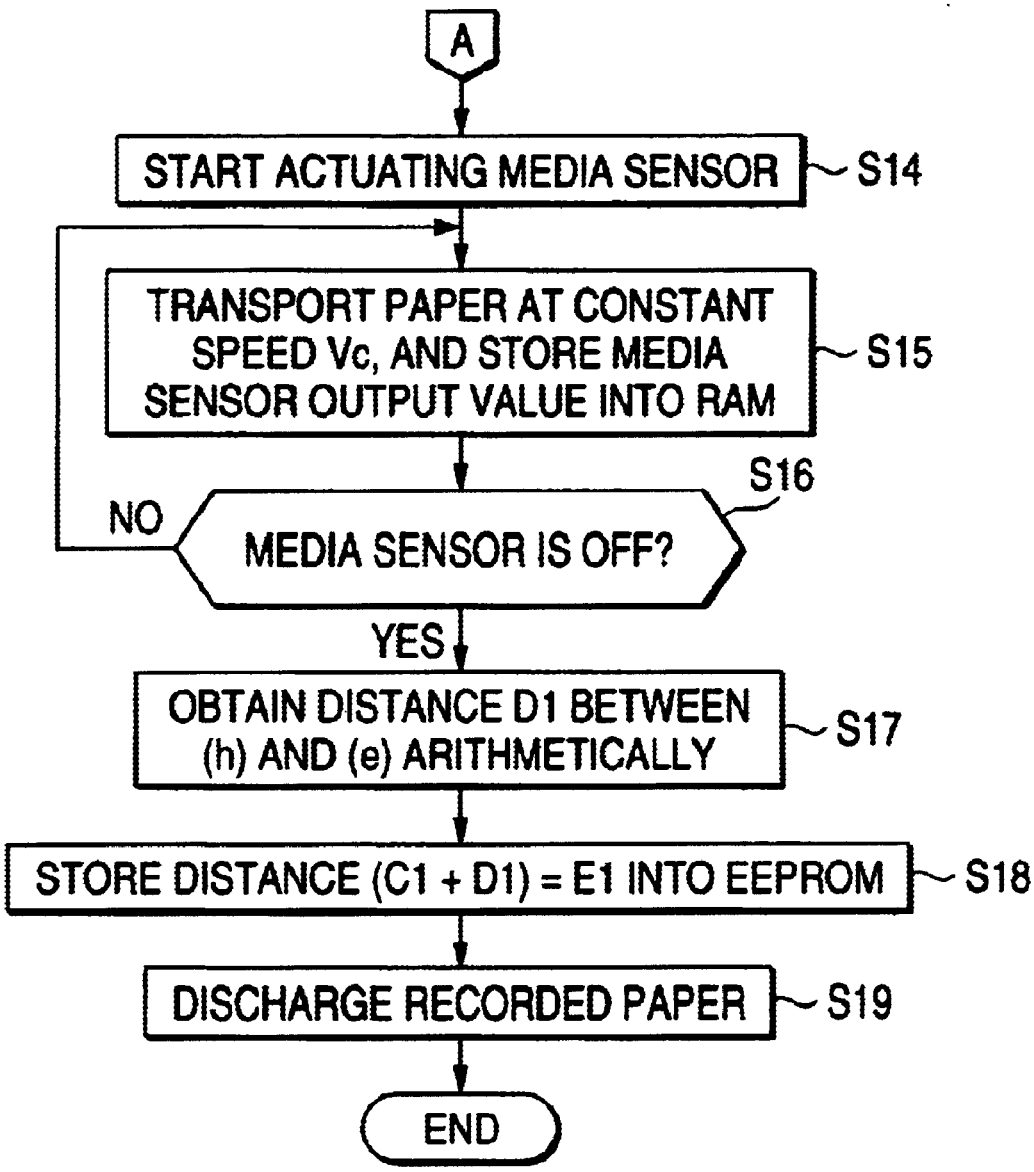
FIG. 10 is a flow chart of the second half of the first paper measurement process.

Next, as shown in FIG. 10, actuating the media sensor 68 is started (S14) in order to obtain the first transport distance E1. In order to obtain a stable detection result, transporting the paper P at a constant speed Vc (for example, 5 ips) is started. A feed amount D from the paper transport temporary stop position (h) is counted and updated based on a detection signal from the paper transport encoder 50, like the feed amount C, while being stored in the RAM 73 (S15). When the rear end of the paper P passes through the media sensor 68 (to thereby turn the sensor off) (S16; Yes), the feed amount D at that time is stored as D1 (S17). In addition, the first transport distance E1 is obtained from the feed amount D1 and the feed amount C1, and the obtained value is stored in the EEPROM 74 (S18). The paper P is discharged (S19). Thus, the first paper measuring process is terminated.

Figure 11:
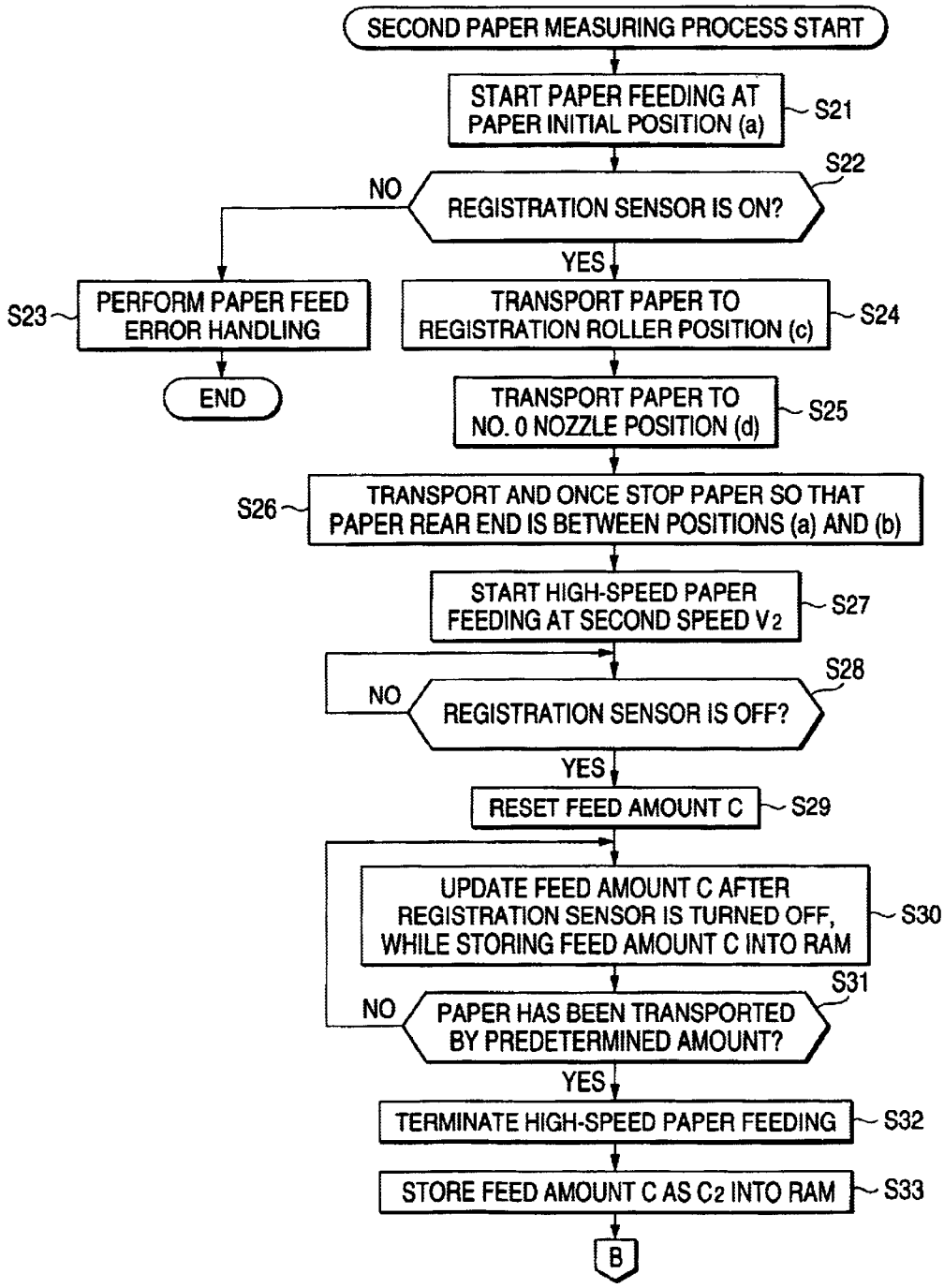
FIG. 11 is a flow chart of the first half of a second paper measurement process.

Next, as shown in FIG. 11, when the second paper measuring process is started, first, the steps S21 to S25 similar to the steps S1 to S5 in FIG. 9 are executed. After that, the paper P is transported so that the rear end of the paper is located between the paper initial position (a) and the registration sensor position (b). The paper P is then stopped temporarily (S26). After that, high-speed feeding of the paper is started with the paper transport speed set as the second speed V2 (8 ips) (S27).

The high-speed feeding of the paper is kept on for a distance enough for the paper to go through the registration sensor position (b), that is, the high-speed feeding of the paper is kept on till the rear end of the paper P reaches the paper transport temporary stop position (h) in FIG. 7. Incidentally, as for the paper transport temporary stop position (h), the distance to the No.0 nozzle position (d) or the media sensor position (e) does not have to be defined. The paper transport temporary stop position (h) serves as a standard for temporarily stopping the paper P short of the media sensor 68 in order to improve the accuracy of detection of the rear end of the paper by the media sensor 68. In the state where the high-speed feeding of the paper is started, the registration sensor 69 is on. Next, it is judged whether the registration sensor 69 is off or not (S28). When the rear end of the high-speed fed paper P passes through the registration sensor 69 so that the registration sensor 69 is actuated and turned off (S28; Yes), a feed amount C is reset (S29). After that, the feed amount C after the registration sensor 69 is turned off is counted and updated based on a detection signal from the paper transport encoder 50 while being stored in the RAM 73 (S30).

After that, when the paper P is transported by a predetermined feed amount required for the rear end of the paper to reach the paper transport temporary stop position (h) (S31; Yes), the high-speed feeding of the paper is terminated (S32). The feed amount C at the time of the termination of the high-speed feeding of the paper is stored as C2 in the RAM 73 (S33). Here, as shown in FIG. 7, the position (h) of the rear end of the high-speed fed paper P is substantially a position advanced downstream by the feed amount C2 from the registration sensor position (b).

Figure 12:
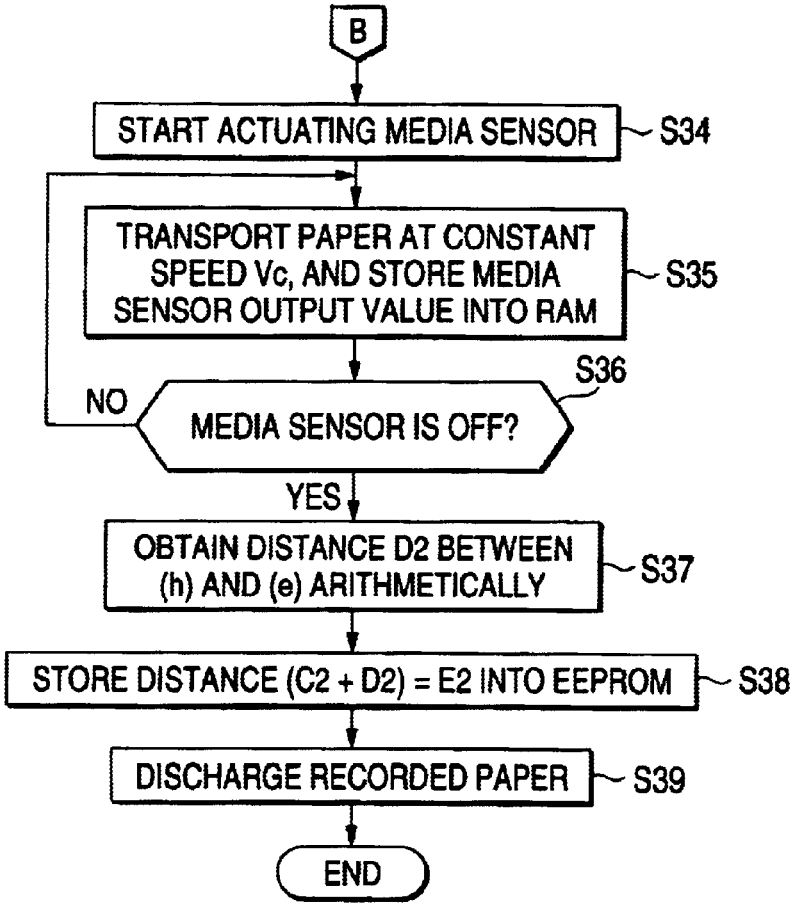
FIG. 12 is a flow chart of the second half of the second paper measurement process.

Next, as shown in FIG. 12, actuating the media sensor 68 is started (S34) in order to obtain the second transport distance E2. In order to obtain a stable detection result, transporting the paper P at a constant speed Vc (for example, 5 ips) is started. A feed amount D from the paper transport temporary stop position (h) is counted and updated based on a detection signal from the paper transport encoder 50, like the feed amount C, while being stored in the RAM 73 (S35). When the rear end of the paper P passes through the media sensor 68 (to thereby turn the sensor off) (S36; Yes), the feed amount D at that time is stored as D2 (S37). In addition, the second transport distance E2 is obtained from the feed amount D2 and the feed amount C2, and the obtained value is stored in the EEPROM 74 (S38). The paper P is discharged (S39). Thus, the second paper measuring process is terminated.

In such a manner, the distance with which the paper P has been transported since the detection of the rear end of the paper by the registration sensor 69 and till the detection of the rear end of the paper by the media sensor 68 is measured as the first transport distance E1 in the case where the paper P is transported at the first speed V1 of low speed when the rear end of the paper is passing through the registration sensor 69. On the other hand, the distance with which the paper P has been transported since the detection of the rear end of the paper by the registration sensor 69 and till the detection of the rear end of the paper by the media sensor 68 is measured as the second transport distance E2 in the case where the paper P is transported at the second speed V2 of high speed when the rear end of the paper is passing through the registration sensor 69. The first transport distance E1 is larger than the second transport distance E2 due to the existence of a sensor operating time (response delay time) after the rear end of the paper passes through the registration sensor 69 and till the sensor signal is changed over.

Figure 13:
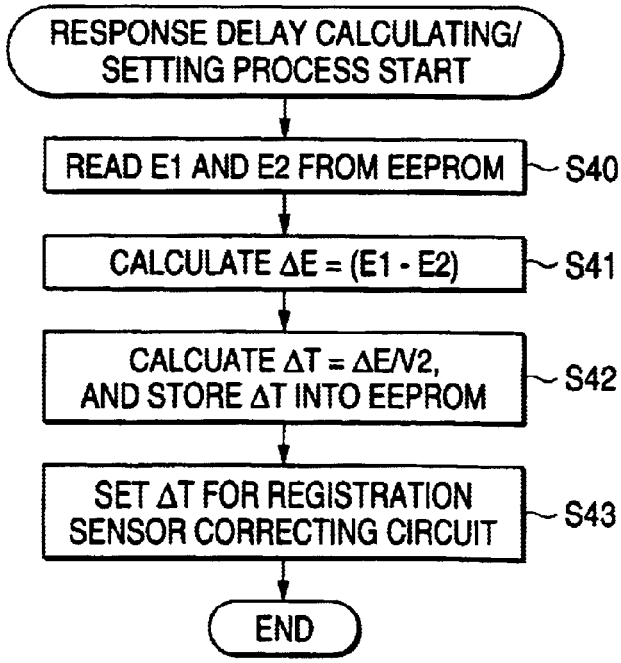
FIG. 13 is a flow chart of a response delay calculating/setting process.

Next, as shown in FIG. 13, when the response delay time calculating/setting process is started, the first paper transport distances E1 and the second paper transport distance E2 are read from the EEPROM 74 (S40), and a difference ΔE (E1−E2) between the first paper transport distances E1 and the second paper transport distance E2 is calculated (S41). Then, the difference ΔE is divided by the second speed V2 of high speed so as to calculate a response delay time $\Delta t=\Delta E/V2$ of the registration sensor 69, and the response delay time Δt is stored in the EEPROM 74 (S42). The response delay time Δt is set for the registration sensor correction circuit 75 (S43). Thus, the process is terminated.

Here, the response delay time Δt is a sensor operating time with which the sensor signal is changed over after the rear end of the paper passes through the registration sensor 69, as described previously. When V1 can be approximated to 0, the response delay time Δt can be obtained from ΔE/V2. When V1 cannot be approximated to 0, the response delay time Δt may be obtained from $\Delta t=\Delta E/(V2-V1)$. Incidentally, when V1 can be approximated to 0, the real distance between the registration sensor position (b) and the media sensor position (e) can be set as E1. When V1 cannot be approximated to 0, the real distance may be set by additional measurement.

Figure 14:
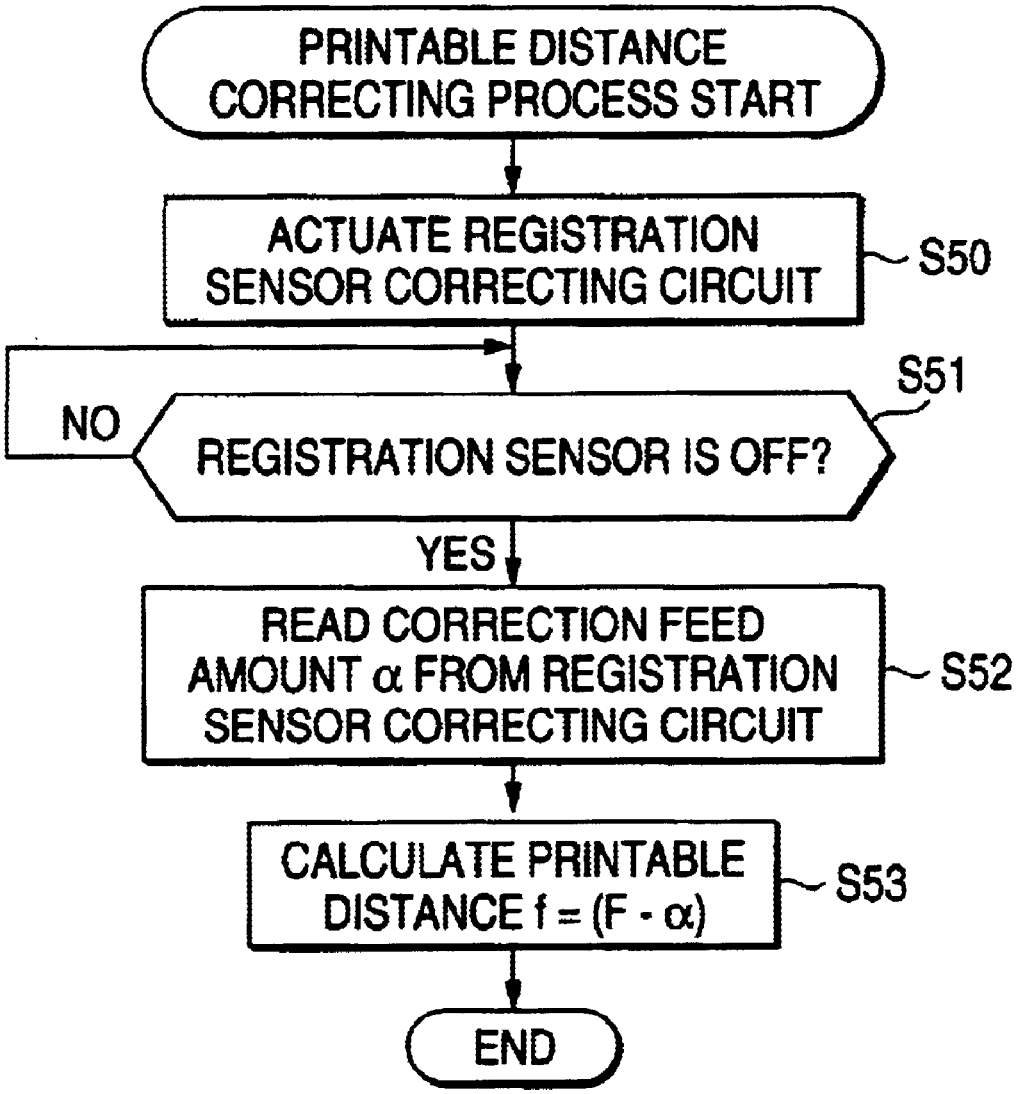
FIG. 14 is a flow chart of a printable distance correcting process.

Next, control to be executed by the control unit 70 based on the printable distance correcting process program in a use stage of the printer 3 will be described with reference to the flow chart of FIG. 14. Incidentally, each reference sign Si (i=50, 51, 52 . . . ) in the flow chart designates each step. Incidentally, the printable distance correcting process is carried out together with control of paper front end detection or the like in the print control which will be described later.

The printable distance correcting process is started in a use stage of the printer 3 where the paper P is fed by the paper feed mechanism 64 and the registration sensor 69 is turned on. As shown in FIG. 14, when the printable distance correcting process is started, first, the registration sensor correction circuit 75 is actuated (S50). When the registration sensor 69 is turned off (S51; Yes), a correction feed amount α (or a counted value based on an encoder signal from the paper transport encoder 50) which is a paper transport distance for the response delay time Δt immediately before the registration sensor 69 is turned off is outputted, and the correction feed amount α is read by the registration sensor correction circuit 75 (S52).

In a tune-up stage of the printer 3, the response delay time Δt is set for the registration sensor correction circuit 75. Once the registration sensor correction circuit 75 is actuated, the counted value of the encoder signal from the present time at least till the response delay time Δt is updated while being stored in a register, based on the encoder signal from the paper transport encoder 50. As soon as the registration sensor 69 is turned off, the correction feed amount α based on the counted value (or the counted value itself) till the response delay time Δt is outputted from the register.

Next, after the step S52, the correction feed amount a is subtracted from the real distance F between the registration sensor position (b) and the No.0 nozzle position (d) so as to calculate a printable distance after the registration sensor 69 is turned off, that is, a printable distance f between the rear end of the paper at the time when the registration sensor 69 is turned off and the No.0 nozzle position (d) (S53). Print control near the rear end of the paper is performed based on the printable distance f.

Figure 8:
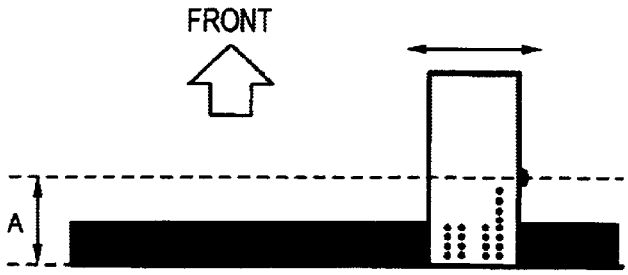
FIG. 8 is an explanatory view of measurement of a distance between a No.0 nozzle and a media sensor.

Here, the distance F between the registration sensor position (b) and the No.0 nozzle position (d) is a value obtained by subtracting the distance A between the No.0 nozzle position (d) and the media sensor position (e) from the distance between the registration sensor position (b) and the media sensor position (e). This distance A is measured as shown in FIG. 8. That is, first, dense printing in the paper transport direction is performed on the paper P with the No.0 nozzle and black ink. The printing is stopped as soon as the print width reaches a certain width (for example, 1 cm).

After that, the paper P is transported with the media sensor 68 being actuated. When a blank portion is detected by the media sensor 68 after a printed portion has continued to be detected, the paper transport amount from the start time of the printing till that time is detected and stored in the EEPROM 74 as the distance A. On the other hand, as for the distance between registration sensor position (b) and the media sensor position (e), the distance E1 measured when the paper is transported at the first speed V1 may be set and stored in the EEPROM as described previously.

Incidentally, to perform the printable distance correcting process, the registration sensor 69 is disposed at a position where the registration sensor 69 is turned off while paper transporting operation for print is being performed. More specifically, the registration sensor 69 is disposed upstream of the print head 10 by a predetermined distance from the No.0 nozzle position (d), that is, the upstream end of the print head (print unit). The predetermined distance corresponds to at least the length of a printing region on the paper P in the paper transport direction to be printed by the print head 10.

In addition, the media sensor 68 is disposed in a region in a paper transporting direction where the print head 10 performs a printing operation.

Incidentally, the control unit 70 and the first paper measuring process of FIGS. 9 and 10 to be executed by the control unit 70 correspond to the first measuring unit. The second paper measuring process of FIGS. 11 and 12 correspond to the second measuring unit. The response delay calculating/setting process of FIG. 13 corresponds to the response delay calculating unit. The printable distance correcting process of FIG. 14 corresponds to the correction unit.

In such a manner, according to this printer 3, in a tune-up stage of the printer 3 after assembling, the rear end of the paper P is detected by the registration sensor 69 while the paper P is transported at the first speed V1 of low speed by the paper transport mechanism 14. After that, the paper is transported till the rear end of the paper is detected by the media sensor 68. Thus, the first transport distance E1 with which the paper has been transported since being detected by the registration sensor 69 and till being detected by the media sensor 68 can be obtained.

In this case, since the rear end of the paper P is detected by the registration sensor 69 while the paper P is transported at the first speed V1 of low speed, the movement distance α (transport distance α as an error) with which the paper P has been moved for the sensor operating time Δt (response delay time Δt) after the rear end of the paper passes through the registration sensor 69 and till the sensor signal is changed over is slight, substantially 0. Therefore, the first transport distance E1 with which the paper P has been moved since being detected by the registration sensor 69 and till being detected by the media sensor 68 is regarded as a transport distance including only a slight error.

Next, in a tune-up stage of the printer 3 after assembling, the rear end of the paper P is detected by the registration sensor 69 while the paper P is transported at the second speed V2 of high speed by the paper transport mechanism 14. After that, the paper is transported till the rear end of the paper is detected by the media sensor 68. Thus, the second transport distance E2 with which the paper has been transported since being detected by the registration sensor 69 and till being detected by the media sensor 68 can be obtained.

In this case, since the rear end of the paper P is detected by the registration sensor 69 while the paper P is transported at the second speed V2 of high speed, the movement distance α (transport distance a as an error) with which the paper P has been moved for the sensor operating time Δt (response delay time Δt) after the rear end of the paper passes through the registration sensor 69 and till the sensor signal is changed over is large. Therefore, the second transport distance E2 with which the paper P has been moved since being detected by the registration sensor 69 and till being detected by the media sensor 68 is regarded as a transport distance including a significant error.

Next, in a tune-up stage of the printer 3 after assembling, the response delay time Δt of the registration sensor 69 is calculated using the difference ΔE between the first transport distance E1 and the second transport distance E2, and stored in the EEPROM 74. The response delay time Δt of the registration sensor 69 is set for the registration sensor correction circuit 75. The response delay time Δt can be obtained by the arithmetic expression $\Delta t=(E1-E2)/V2$.

Then, in a use stage of the printer 3, the remaining printable distance f on the rear end side of the paper after detecting the rear end of the paper by the registration sensor 69 can be corrected using the response delay time Δt stored in the EEPROM 74 and set for the registration sensor correction circuit 75. Thus, the accuracy of calculation of the remaining printable distance on the rear end side of the paper after detection of the rear end of the paper by the registration sensor 69 can be enhanced. As a result, when an image or the like is printed up to the lower end of the paper P, it is possible to solve the problem that there occurs a blank space, a picture image is short, etc.

In addition, for each printer 3, in a tune-up stage of the printer 3 after assembling, the response delay time Δt is calculated and stored in the control unit 70 of the printer 3. In a use stage of the printer 3, the remaining printable distance on the rear end side of the paper is corrected using the response delay time Δt. Thus, the accuracy of calculation of the response delay time can be enhanced so that the remaining printable distance can be corrected accurately.

The registration sensor correction circuit 75 is provided for calculating the paper transport distance a at the response delay time Δt immediately before the registration sensor 69 is turned off, and the remaining printable distance f is corrected using the paper transport distance a calculated by the registration sensor correction circuit 75. It is therefore possible to correct the remaining printable distance accurately regardless of whether the transport speed during printing is fast or slow.

Incidentally, in place of the registration sensor correction circuit 75, the remaining printable distance f on the rear end side of the paper after detecting the rear end of the paper by the registration sensor 69 may be calculated by software with the microcomputer having the CPU 71, the ROM 72, the RAM 73 and the EEPROM 74. At that time, the remaining printable distance on the rear end side of the paper may be corrected with the paper movement distance α obtained by use of the response delay time Δt and the transport speed V during printing, in consideration of the movement distance with which the paper P has moved for the response delay time Δt.

Figure 15:
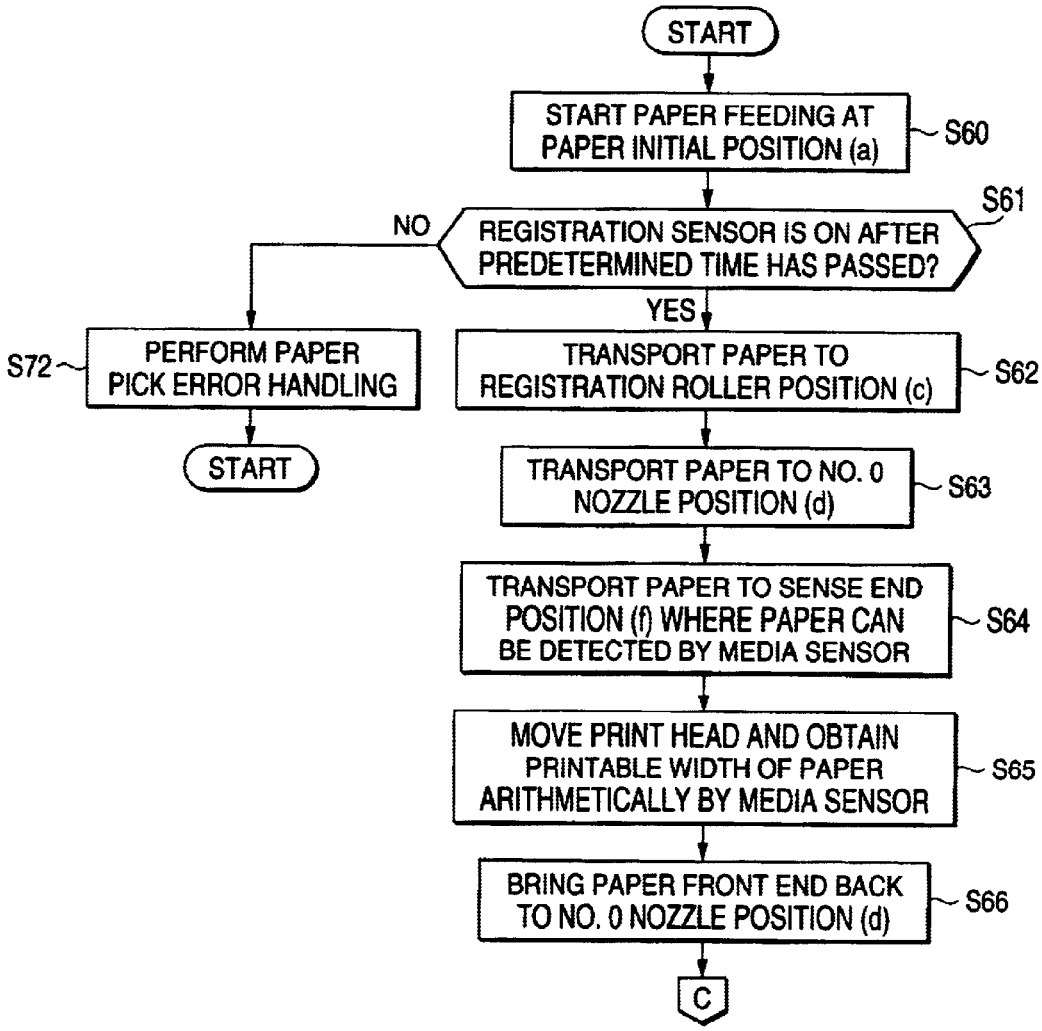
FIG. 15 is a flowchart of a part of paper front end detection control.
Figure 16:
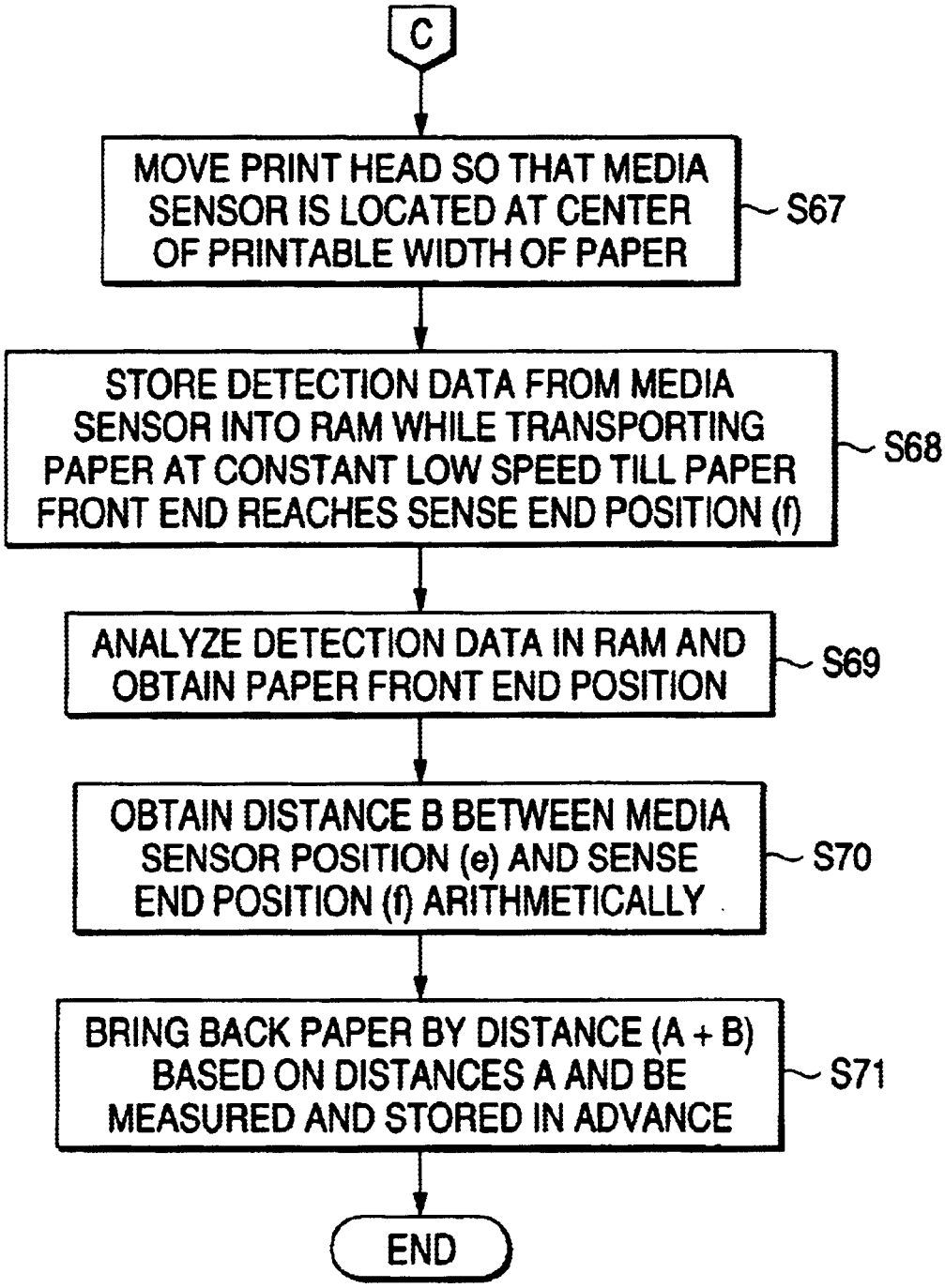
FIG. 16 is a flow chart of the rest of the paper front end detection control.

Next, the paper front end detection control for detecting the front end of the paper P fed by the paper feeder 2 prior to the start of printing will be described based on the flow charts of FIGS. 15 and 16 and with reference to FIG. 7.

When this control is started, first, the paper P set in the paper initial position (a) of the paper feeder 2 is fed toward the print unit 3 with the rotation of the paper feed roller 63 (S60). Then, when the registration sensor 69 is turned on before a predetermined time has passed, that is, when the paper P is fed smoothly without falling into a jam (S61; Yes), first, the paper P is transported to the registration roller position (c) (S62).

Figure 17:
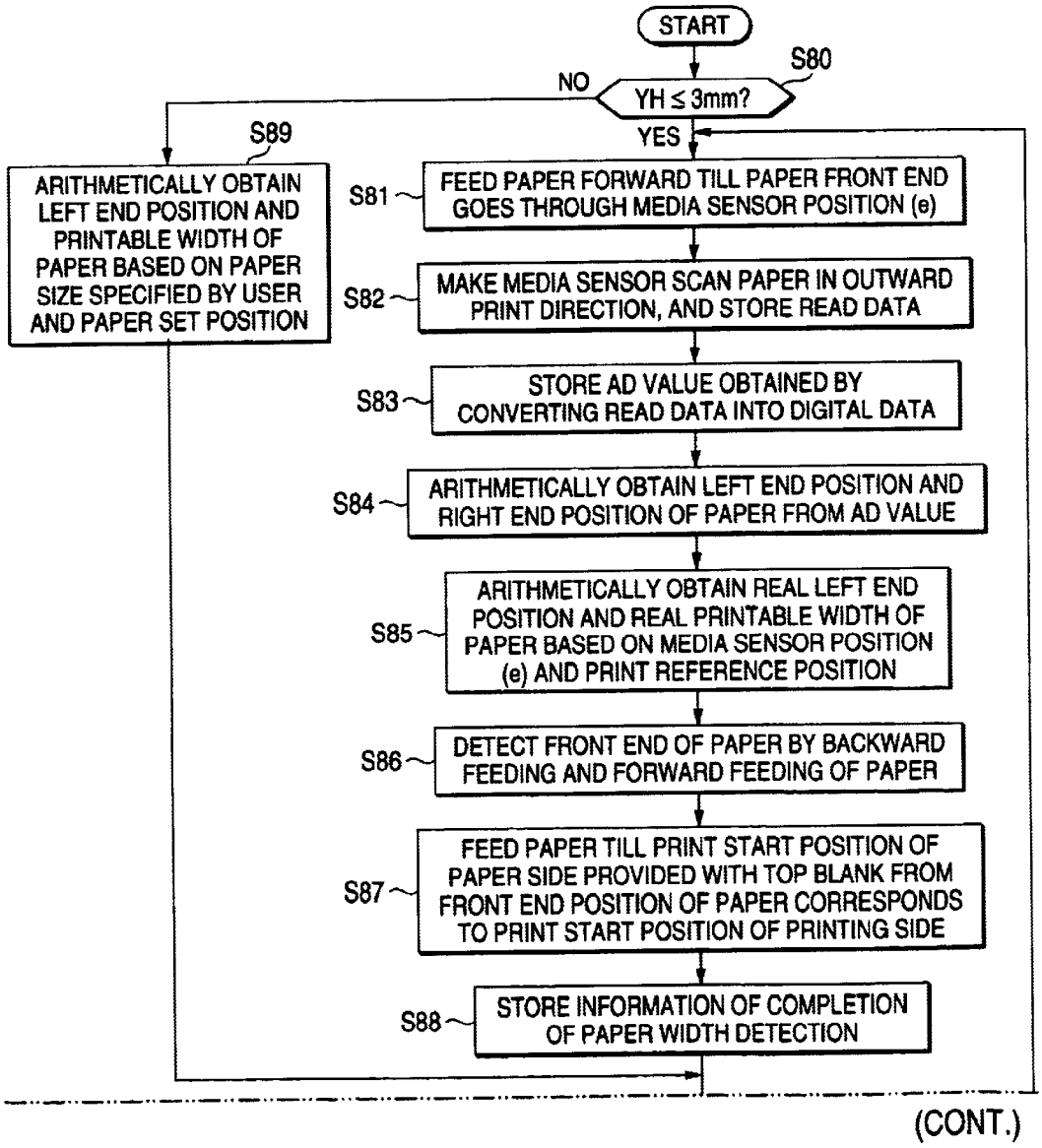
FIG. 17 is a flow chart of paper width detectable print control.

The paper P is further transported to the No.0 nozzle position (d) of the nozzle sets 10*a* to 10*d* of the print head 10, that is, the print start position on the print control by the registration roller 41 (S63). Further, the paper P is transported to the sense end position (f) in which the paper width can be detected by the media sensor 68 (S64). Then, when the paper P is transported to the sense end position (f), the printable width of the paper P is arithmetically obtained (S65) by the paper width detection control particularly similar to steps S82 to S85 of the paper width detectable print control shown in FIG. 17, which will be described later. After that, the paper P is brought back by back feed so that the front end of the paper P reaches a position corresponding to the No.0 nozzle position (d) (S66).

Next, the print head 10 is moved so that the media sensor 68 is located at the center of the printable width of the paper P (S67). Next, while the paper P is transported at a constant low speed, detection data for each very small measurement distance from the media sensor 68 (in this case, analog data as gradation data of so-called 256 gradations) is stored in the RAM 73 sequentially till the front end of the paper P reaches the sense end position (f) (S68). Then, the detection data (gradation data) stored in the RAM 73 is analyzed to obtain the front end position of the paper P (S69). That is, an AD value in which the gradation data has been converted from analog data to digital data is obtained, and the front end position corresponding to a transition position where the AD value has a large change is obtained.

Next, a distance B between the media sensor position (e) and the sense end position (f) is arithmetically obtained (S70) That is, by the step S69, the front end position of the paper P in the media sensor position (e) can be obtained accurately, and the movement distance of the paper P between the media sensor position (e) and the sense end position (f) can be obtained accurately from the encoder signal from the paper transport encoder 50. Then, finally, the paper P is brought back by back feed from the sense end position (f) by the distance obtained by adding the accurate distance B obtained in the Step S70 to the accurate distance A between the No.0 nozzle position (d) and the media sensor position (e) (S71).

Here, as for the distance A, a distance measured accurately when the print unit 3 was installed has been stored as described with reference to FIG. 8. Therefore, the front end of the paper P is fed accurately in a position corresponding to the No.0 nozzle position (d) of the print head 10. When the registration sensor 69 is not turned on through a predetermined time has passed since the paper was fed (S61; No), there is a high probability that the fed paper P has fallen into a jam. Therefore, a paper pick error handling process is executed for stopping the driving of the paper feed motor 65 (S72). Thus, this control is terminated.

In such a manner, the position of the front end of the paper P in the sense end position (f) can be arithmetically obtained correctly and accurately on the basis of detection data detected by the media sensor 68 while the print head 10 is transported slowly at a constant low speed till the front end of the fed paper P reaches the sense end position (f) from the No.0 nozzle position (d). Therefore, printing can be performed with a blank reduced from the upper portion of the paper P.

Next, when the print width of print data submitted for printing is larger than the printable width of the paper P in a print process for each page, paper width detectable print control is carried out for extracting and printing only a portion printable substantially all over the width of the paper P without printing an equal width in a left end portion and a right end portion of the print data. This print control will be described with reference to the flow chart of FIG. 17. In this case, the print data submitted for printing is data received from the personal computer 77 connected to the multifunctional apparatus 1. Therefore, assume that the print data includes not only dot data to be printed really but also data of print resolution (600 dpi, 1200 dpi), data length (dot number) to be printed per line, blank setting data, and so on.

Figure 18:
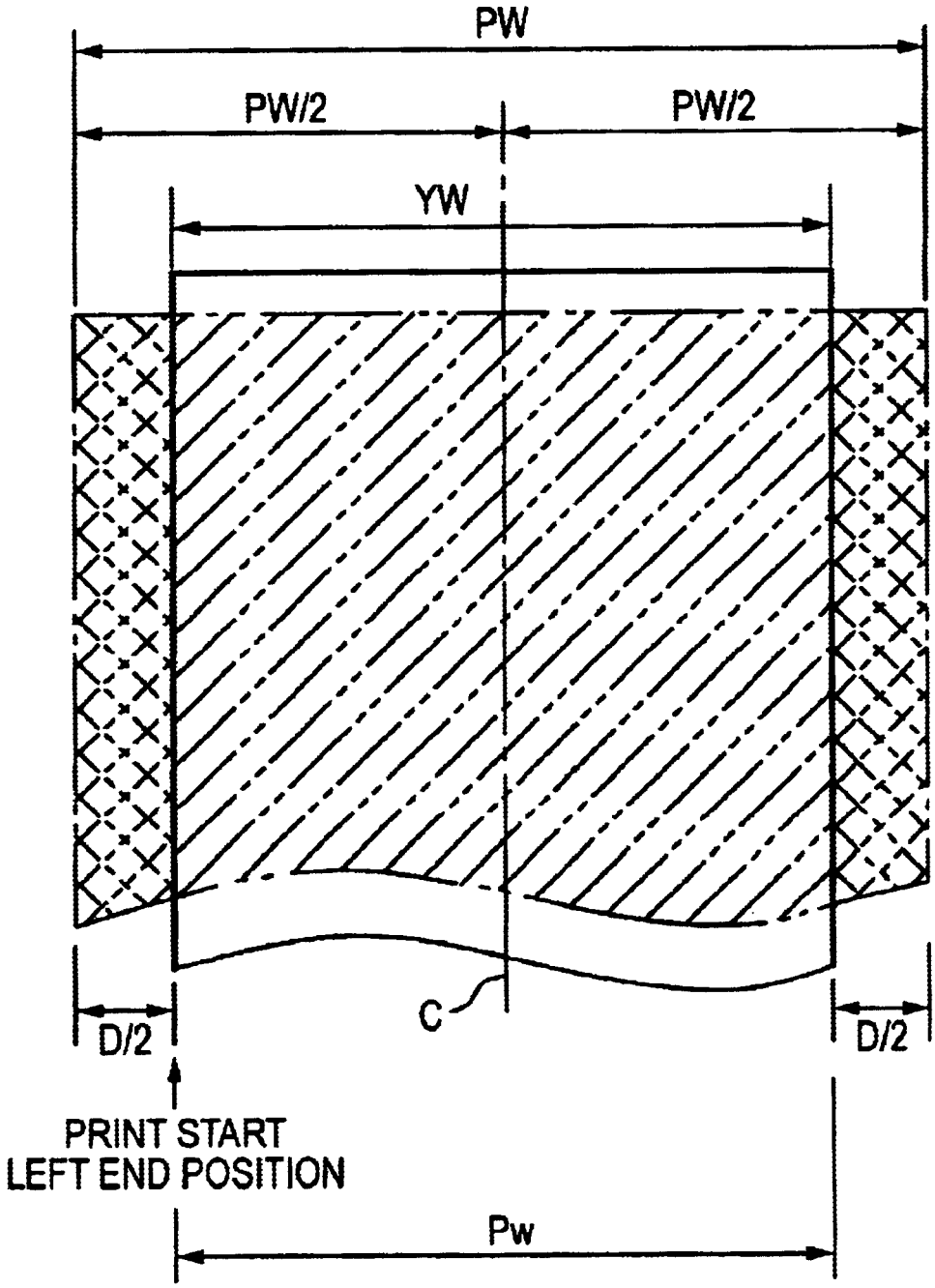
FIG. 18 is an explanatory view for explaining the relationship between a printable range and a print data width.

The print data submitted for printing is received from the external personal computer 77, and a print key is operated on the operation panel 6. First, when the top, bottom, left and right blanks YH are set to "3 mm" or less in the case of borderless printing according to the blank setting data (S80; Yes), the paper P is fed forward to a position where the front end of the paper has been beyond the media sensor position (e) (S81). In this case, as shown in FIG. 18, the print width of the print data, that is, the print data width PW is larger than the printable width YW of the paper P.

Figure 19:
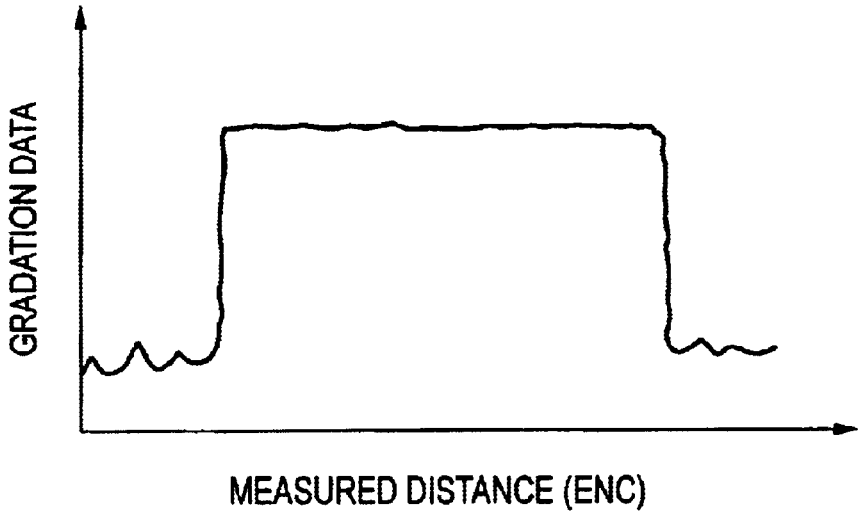
FIG. 19 is a graph showing gradation data at the time of paper detection.

Next, when the printing is started, the print head 10 is located in a predetermined position, that is, in the left end position. Accordingly, the media sensor 68 is made to scan the paper P in the outward print direction (rightward print direction) while facing the paper P. Whenever an encoder signal ENC is received from the carriage feed encoder 39, read data of the paper P, that is, read analog data as gradation data of so-called 256 gradations is stored in the RAM 73 (S82). For example, as shown in FIG. 19, gradation data (analog data) for each very small measurement distance as to the paper P is stored.

Figure 20:
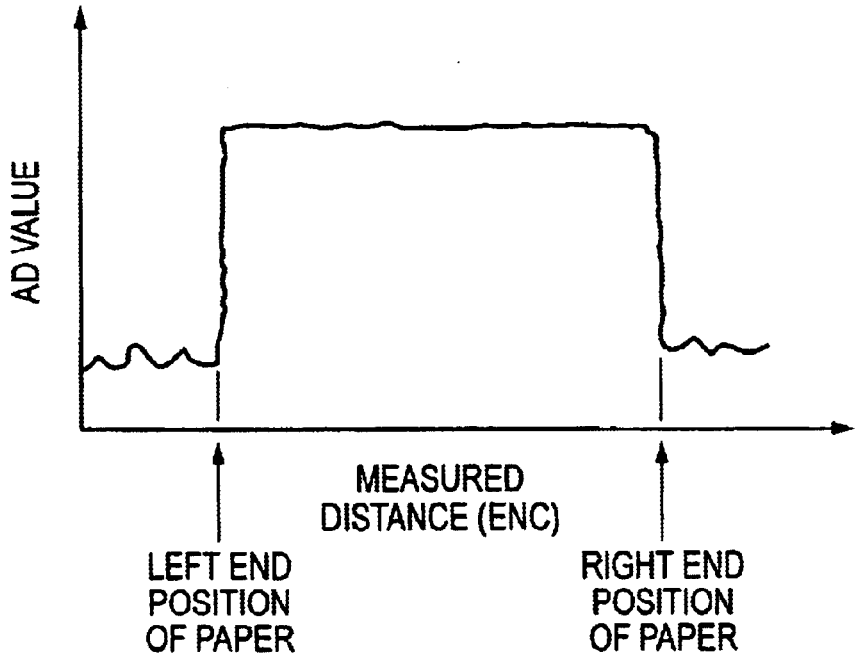
FIG. 20 is a graph showing an AD value at the time of paper detection.

Next, an AD value in which the read data for each very small measurement distance as gradation data has been converted into digital data is arithmetically obtained (see FIG. 20) and stored (S83). Next, the paper left end position corresponding to the left one of transition positions where the AD value has a large change and the paper right end position corresponding to the right one of those transition positions are arithmetically obtained based on the AD value (S84). The media sensor 68 is provided in the left end position of the print head 10, and the real print reference position in the print head 10 is in the left nozzle set 10*a* provided in the print head 10 for black ink. Therefore, the real left end position and the printable width YW of the fed paper P are arithmetically obtained respectively in consideration of the difference between the media sensor position (e) and the position of the reference nozzle set 10*a* (S85).

At this time, since the media sensor 68 is located above the paper P, the front end of the paper P is detected when the paper P is fed backward and forward (S86), as described above. Next, paper feed is carried out so that the paper-side print start position provided with a top blank from the front end position of the paper P corresponds to the No.0 nozzle position (d) which is a printing-side print start position corresponding to the No.0 nozzle of the print head 10 (S87). Next, the information that the paper width detection has been finished by the media sensor 68 is stored in the RAM 73 (S88).

Next, when the print data width PW is not beyond the printable width YW and substantially equal thereto (S90; Yes), printing of one page is carried out without cutting any of the left and right opposite end portions of the print data (S94). On the other hand, when the print data width PW is not equal to the printable width YW (S90; No), and when the printable width YW is larger than the print data width PW (S91; Yes), the print left end position in the print line is changed, in order to locate the print data in the left/right-direction central portion of the paper P (centering) preventing the left and right opposite end portions of the print data from cutting (S92).

On the other hand, when the printable width YW is smaller than the print data width PW (S91; No), it is necessary to cut the left and right opposite end portions of the print data. Therefore, as shown in FIG. 18, a print start left end position is changed to a left side position at a distance of the half width of the printable width YW from the center C of the left/right width of the print data. The print data width PW is also changed to a reduced print data width PW in which the left and right opposite end portions D/2 of the print data width PW have been cut off respectively, where D is difference between the print data width PW and the printable width YW (S93). Here, when the number of dots corresponding to the left and right opposite end portions D/2 of the print data width PW are cut off therefrom respectively, mask dot processing may be performed for each print dot line by a control program so as to execute the cutting process by software.

The control unit 70 may be provided with an ASIC (Application Specific Integrated Circuit) configured by a hard logic circuit, so as to use the ASIC to perform mask dot processing by hardware. In this case, only by setting the number of dots to be cut, the cutting process can be performed bit by bit easily. Incidentally, when bordered printing is performed and the top, bottom, left and right blanks YH are set to be larger than "3 mm" (S80; No), the predetermined left end position of the paper P and the printable width YW are arithmetically obtained based on a paper size (for example, A-4 size) specified by a user and a predetermined paper set position in the paper feed unit 2 (S89). Then, the step S90 and the following procedures are executed.

In such a manner, when the print width PW of the print data submitted for printing is larger than the printable width YW of the paper P, the printable width YW of the paper P is arithmetically obtained accurately using the media sensor 68. Further, the center C of the print data width PW is brought into line with the center C of the printable width YW, and the overflow portions D/2 of the print data overflowing on the left and right opposite sides of the printable width YW are cut off respectively. Thus, printing is performed while surely preventing any of the print data from overflowing from the printable width YW. Accordingly, good-looking printing can be obtained without allowing ink sprayed from the nozzles of the print head 10 to adhere to the platen or the paper transport path and without allowing the ink to stain the paper P.

Incidentally, in the above embodiment, the sensor disposed upstream in the transport path of paper is the registration sensor 69 of a mechanical type and the sensor disposed downstream is a media sensor 68 of an optical type. However, this is not to be considered as being limitative of the invention. It would be possible to use mechanical type of sensors as both of the upstream and downstream sensors. It would be also possible to use optical type of sensors as both of the upstream and downstream sensors.

According to the embodiment, there are provided the registration sensor 69, the media sensor 68, and the control unit 70 (corresponding to a first measuring unit, a second measuring unit, a response delay calculating unit and a correction unit). Thus, it is possible to enhance the accuracy of calculation of the remaining printable distance on the paper rear end side after detection of the rear end of the paper by the registration sensor 69. As a result, when an image or the like is printed up to the lower end of paper, it is possible to solve the problem that there occurs a blank space, a picture image is short, etc. In addition, for each printer 3, a response delay time is calculated and stored in the control unit 70 of the printer 3. The remaining printable distance on the rear end side of the paper is corrected using the response delay time. Thus, the accuracy of calculation of the response delay time can be enhanced so that the remaining printable distance can be corrected accurately.

According to the embodiment, the registration sensor 69 is a mechanical sensor for performing detection with a detector in contact with the paper. Accordingly, the response delay time is apt to increase, but even in this case, it is possible to satisfactorily enhance the accuracy of calculation of the remaining printable distance on the paper rear end side. Since the media sensor 68 mounted on the print head is an optical sensor including a light-emitting portion and a light-receiving portion, the left and right ends or the front and rear ends of the paper can be detected with high responsibility.

According to the embodiment, the correction unit includes an upstream sensor correcting unit for calculating a paper transport distance in the response delay time when the registration sensor 69 detects absence of paper, and the remaining printable distance is corrected by use of the paper transport distance calculated by the upstream sensor correcting unit. Accordingly, correction can be carried out accurately regardless of whether the transport speed during printing is fast or slow.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A printer comprising:

a paper transport unit that transports paper fed thereto;

a print unit that prints on the paper, including a print head;

a downstream sensor mounted on the print head and capable of detecting the paper;

an upstream sensor disposed upstream of the downstream sensor in a paper-transport-direction and capable of detecting the paper;

a first measuring unit configured to make the paper transport unit transport the paper at a first speed of low speed while making the upstream sensor detect a rear end of the paper, and to make the paper transport unit transport the paper till the downstream sensor detects the rear end of the paper, so as to obtain a first transport distance with which the paper has been transported since being detected by the upstream sensor and till being detected by the downstream sensor;

a second measuring unit configured to make the paper transport unit transport the paper at a second speed of high speed while making the upstream sensor detect the rear end of the paper, and to make the paper transport unit transport the paper till the downstream sensor detects the rear end of the paper, so as to obtain a second transport distance with which the paper has been transported since being detected by the upstream sensor and till being detected by the downstream sensor;

a response delay calculating unit configured to calculate a response delay time of the upstream sensor according to a difference between the first transport distance and the second transport distance; and a correction unit configured to correct a remaining printable distance on a paper rear end side after detecting the rear end of the paper by the upstream sensor, on the basis of the response delay time.

2. The printer according to claim 1, wherein the upstream sensor comprises a mechanical sensor including a detector to be in contact with paper to be detected; and the downstream sensor comprises an optical sensor.

3. The printer according to claim 2, wherein the correction unit includes an upstream sensor correcting unit configured to calculate a paper transport distance in the response delay time when the upstream sensor detects absence of paper; and the remaining printable distance is corrected on the basis of the paper transport distance calculated by the upstream sensor correcting unit.

4. The printer according to claim 1, wherein the first speed is a minimum speed for transporting paper in a printing operation of the printer; and the second speed is a maximum speed for transporting paper in a printing operation of the printer.

5. The printer according to claim 4, wherein the minimum speed corresponds to a paper transport speed for performing the printing operation in the highest resolution that is executable by the printer.

6. The printer according to claim 4, wherein the maximum speed corresponds to a paper transport speed for performing the printing operation in the lowest resolution that is executable by the printer.

7. The printer according to claim 4, wherein the maximum speed is equivalent to a paper transport speed while the print head is not being driven.

8. The printer according to claim 1, wherein the print unit further includes a carriage on which the print head is mounted, the carriage configured to move reciprocally in a direction substantially perpendicular to a paper transport direction; and the downstream sensor is mounted on the carriage.

9. The printer according to claim 1, wherein the upstream sensor is disposed at a position where the upstream sensor is turned off while paper transporting operation for print is being performed.

10. The printer according to claim 9, wherein the upstream sensor is disposed upstream of the print unit at a distance at least corresponding to the length of a printing region of the print unit from an upstream end of the print unit.

11. The printer according to claim 1, wherein the downstream sensor is disposed in a region in a paper transporting direction where the print unit performs a printing operation.

12. A printing method in a printer, wherein the printer includes a downstream sensor capable of detecting paper, and an upstream sensor disposed upstream of the downstream sensor in a paper-transport-direction and capable of detecting the paper, the method comprising:

detecting a rear end of the paper by the upstream sensor and the downstream sensor while transporting the paper at a first speed of low speed;

obtaining a first transport distance with which the paper has been transported since being detected by the upstream sensor and till being detected by the downstream sensor, while transporting the paper at the first speed;

detecting the rear end of the paper by the upstream sensor and the downstream sensor while transporting the paper at a second speed of high speed;

obtaining a second transport distance with which the paper has been transported since being detected by the upstream sensor and till being detected by the downstream sensor, while transporting the paper at the second speed;

calculating a response delay time of the upstream sensor from a difference between the first transport distance and the second transport distance; and correcting a remaining printable distance on a paper rear end side after detecting the rear end of the paper by the upstream sensor, on the basis of the response delay time.

13. The method according to claim 12, wherein the correcting step includes: calculating a paper transport distance in the response delay time when the upstream sensor detects absence of paper; and correcting the remaining printable distance on the basis of the paper transport distance.

14. A printer, comprising:

a downstream sensor capable of detecting paper;

an upstream sensor disposed upstream of the downstream sensor in a paper-transport-direction and capable of detecting the paper;

means for obtaining a first transport distance with which the paper has been transported since being detected by the upstream sensor and till being detected by the downstream sensor, while transporting the paper at a first speed of low speed;

means for obtaining a second transport distance with which the paper has been transported since being detected by the upstream sensor and till being detected by the downstream sensor, while transporting the paper at a second speed of high speed;

means for calculating a response delay time of the upstream sensor from a difference between the first transport distance and the second transport distance; and means for correcting a remaining printable distance on a paper rear end side after detecting the rear end of the paper by the upstream sensor, on the basis of the response delay time.

* * * * *